US007677355B2

(12) United States Patent
Imamura et al.

(10) Patent No.: US 7,677,355 B2
(45) Date of Patent: Mar. 16, 2010

(54) SPEAKER DIAPHRAGMS, MANUFACTURING METHODS OF THE SAME, AND DYNAMIC SPEAKERS

(75) Inventors: Satoshi Imamura, Kitagunma-gun (JP); Takeshi Hirano, Sagamihara (JP); Tomoaki Ogata, Maebashi (JP); Toshikatsu Kuwahata, Gunma-gun (JP)

(73) Assignee: Victor Company of Japan, Limited, Yokohama, Kanagawa-ken (JP)

( * ) Notice: Subject to any disclaimer, the term of this patent is extended or adjusted under 35 U.S.C. 154(b) by 0 days.

(21) Appl. No.: 12/292,327

(22) Filed: Nov. 17, 2008

(65) Prior Publication Data

US 2009/0090453 A1 Apr. 9, 2009

Related U.S. Application Data

(62) Division of application No. 10/778,343, filed on Feb. 17, 2004, now Pat. No. 7,467,686.

(30) Foreign Application Priority Data

| | | |
|---|---|---|
| Feb. 19, 2003 | (JP) | 2003-041356 |
| Feb. 19, 2003 | (JP) | 2003-041398 |
| Feb. 24, 2003 | (JP) | 2003-046264 |
| Feb. 24, 2003 | (JP) | 2003-046322 |
| Mar. 4, 2003 | (JP) | 2003-056569 |

(51) Int. Cl.
*H04R 7/06* (2006.01)

(52) U.S. Cl. ..... 181/167; 381/426

(58) Field of Classification Search ..... 181/167, 181/168, 169, 170, 157; 381/426, 427, 428, 381/423

See application file for complete search history.

(56) References Cited

U.S. PATENT DOCUMENTS

| | | | |
|---|---|---|---|
| 4,699,242 | A | 10/1987 | Ono |
| 5,219,564 | A | 6/1993 | Zalipsky et al. |
| 5,256,837 | A | 10/1993 | Pak |
| 6,063,862 | A | 5/2000 | Idemura et al. |
| 6,554,962 | B2 | 4/2003 | Uryu et al. |

(Continued)

FOREIGN PATENT DOCUMENTS

| | | |
|---|---|---|
| JP | 54-29626 | 3/1979 |

(Continued)

*Primary Examiner*—Jeffrey Donels
*Assistant Examiner*—Jeremy Luks
(74) *Attorney, Agent, or Firm*—The Nath Law Group; Jerald L. Meyer; Derek Richmond

(57) ABSTRACT

On one surface of a piece of wooden sheet, a cloth or paper is adhered to make an adhered sheet. An approximately V-shaped notch is provided on the adhered sheet, the adhered sheet is wetted to be softened, and a lubricant which acts to keep water is impregnated thereinto. Edge portions of the notch are overlapped, and the adhered sheet is tentatively molded in an approximately horn shape by a first hot press molding. The adhered sheet is then dried, impregnated with thermosetting resin, and half-dried. The adhered sheet is subject to a second hot press molding. A moisture-proof agent is applied on the adhered sheet, a center hole for a voice coil and periphery are removed to make a speaker diaphragm having a predetermined dimension and shape.

14 Claims, 29 Drawing Sheets

U.S. PATENT DOCUMENTS

| | | | |
|---|---|---|---|
| 2002/0096298 | A1 | 7/2002 | Uryu et al. |
| 2003/0150572 | A1 | 8/2003 | Uryu et al. |

FOREIGN PATENT DOCUMENTS

| | | | |
|---|---|---|---|
| JP | 55-88587 | | 6/1980 |
| JP | 59-030396 | | 2/1984 |
| JP | 59-221200 | | 12/1984 |
| JP | 62-224196 | | 10/1987 |
| JP | 64-082896 | | 3/1989 |
| JP | 01-288100 | | 11/1989 |
| JP | 03-201795 | | 9/1991 |
| JP | 03231998 | A | 10/1991 |
| JP | 05-083792 | | 4/1993 |
| JP | 05-328487 | | 12/1993 |
| JP | 06-178386 | | 6/1994 |
| JP | 07-170595 | | 7/1995 |
| JP | 08133960 | A | 5/1996 |
| JP | 10-304492 | | 11/1998 |
| JP | 2000-059883 | | 2/2000 |

(g1)

(h1)

(i1)

(j1)

(a2)

(b2)

(h3)

(g4)

(h4)

(i4)

(j4)

(g5)

(h5)

(i5)

(j5)

(e8)

(h8)

(d8)

(i8)

(g8)

(g82)

(g83)

SPEAKER DIAPHRAGMS, MANUFACTURING METHODS OF THE SAME, AND DYNAMIC SPEAKERS

CROSS REFERENCE TO EARLIER FILED APPLICATION

This application is a divisional application of U.S. patent application Ser. No. 10/778,343, filed Feb. 17, 2004, the entire contents of which are hereby incorporated in their entirety.

BACKGROUND OF THE INVENTION

1. Field of the Invention

The present invention relates to speaker diaphragms used for audio speakers, manufacturing methods of the same, and dynamic speakers.

2. Description of the Related Art

Conventional diaphragms for dynamic speakers are inmost cases made of paper pulp, plastic or metal such as aluminum. These conventional diaphragms are made by press molding of a homogeneous material, and therefore, velocities of sounds propagated from the center of the diaphragm in various radial directions thereof are equal to each other. Accordingly, with regard to the conventional diaphragms, standing waves are always generated and resonance points appear. Moreover, sound pressure frequency characteristics are deteriorated due to split vibrations in low frequency regions. Furthermore, feeling of being at a live performance or the like will be lost.

In addition, although the diaphragms made of paper pulp or plastic have relatively high internal loss coefficients, they are not good in terms of stiffness (Young's modulus), and sound wave velocities thereof are low. Definition of the reproduced sounds is therefore not satisfying. In contrast, the diaphragms made of metal such as aluminum have high sound wave velocities. However, the internal loss coefficients thereof are low, and therefore, amplitude attenuation is small. Consequently, there is a drawback that reproduced sounds are not clearly divided (that is sounds are not sharp).

Instead of such diaphragms made of existing materials, which have both advantages and drawbacks, wooden diaphragms are desired to be realized as speaker diaphragms that can reproduce more natural sounds.

The sound wave velocities of wood vary according to the kinds of wood. However, in general, wood has higher sound wave velocities than paper pulp. Moreover, the sound wave velocities in the grain direction and those in a direction perpendicular to the grain are different from each other. Wood has an anisotropic propagation characteristic, in which the propagation velocities in the grain direction (referred to as a "longitudinal direction") are relatively high, while the propagation velocities in the direction perpendicular to the grain (referred to as a "horizontal direction") are relatively low. Moreover, in general, wood has internal loss coefficients appropriate as speaker diaphragms, and is light and strong (high stiffness).

Hence, with regard to the wooden diaphragms, in which wood is used as basis material as it is, standing waves are not generated normally and resonance points hardly appear. Therefore, it can be expected that sound pressure frequency characteristics in low frequency regions are improved, and definition and sharpness of the reproduced sounds can be enhanced compared to the existing diaphragms made of paper pulp.

Various manufacturing methods have already been proposed in, for example, the following publicly known documents as manufacturing methods of wooden diaphragms or dynamic speakers employing the wooden diaphragms.

In Japanese Patent Laid-Open No. Sho 62(1987)-224196 (Patent Document 1), described is a speaker using, as a flat diaphragm for the speaker, a thin, flat wooden board treated to a wood plastic combination (WPC). Here, the thin, flat wooden board is impregnated with plastic such as polyester.

In Japanese Patent Laid-Open No. Hei 1(1989)-288100 (Patent Document 2), described is a cone diaphragm 5 manufactured through a manufacturing procedure shown in FIGS. 1A and 1B. As shown in FIG. 1A, a wooden sheet 1, a development of an approximately horn shape, which has a circular cutout portion 1*a* in the center thereof and a sector-shaped cutout portion 1*b* extended from the cutout portion 1*a*, is removed from one sheet of thin wooden board 4. Then, as shown in FIG. 1B, both edge portions b1 and b2 of the sector-shaped cutout portion 1*b* are overlapped with each other on an overlapping portion 1*c*, and adhered with an adhesive to be formed into the approximately horn shape. Thereafter, the wooden sheet 1 is press molded to be a cone diaphragm 5.

In addition, in Patent Document 2, it is described that a plurality of small wooden pieces 2*a* to 2L shown in FIG. 2A are adhered with an adhesive, made into an approximately horn shape as shown in FIG. 2B, and then press molded to be a cone diaphragm 2. It is also described that physical moisture-proof treatment or chemical moisture-proof treatment is performed onto, the cone diaphragms 2 and 5.

In Japanese Patent Laid-Open No. Hei 5(1993)-83792 (Patent Document 3), an acoustic diaphragm molded in a circular cone shape is described. This diaphragm is produced as follows: a composite sheet made up of a sliced, extremely thin wooden sheet with a thickness of 80 ,,m or less and a non-woven cloth of adhesive resin attached on the back surface thereof are plasticized with a plasticizer; and a plurality of the composite sheets are stacked, heated and pressed.

In Japanese Patent Laid-Open No. Hei 6(1994)-178386 (Patent Document 4), described is a cone diaphragm which is produced as follows: a thin, flat wooden board is cut into a sector shape; the thin wooden board is boiled in hot steam, hot water, or an alkaline solution of pH 10 or more in order to prevent cracks upon molding; and the thin wooden board is press molded into a circular cone shape.

In Japanese Patent Laid-Open No. Hei 10(1998)-304492 (Patent Document 5) described is a speaker diaphragm which is produced as follows: a thin non-woven cloth or Japanese paper is adhered on one surface of a piece of wooden sheet to make an adhered sheet; the adhered sheet is impregnated with a lubricant to get tension and flexibility; and the adhered sheet impregnated with the lubricant is hot press molded to be made into an approximately horn shape.

In Japanese Patent Laid-Open No.2000-59883 (Patent Document 6), described is a speaker diaphragm which is produced as follows. In order to produce a wooden speaker diaphragm in which no wrinkles or cracks occur upon press molding and deterioration with time is small, on one surface of a piece of wooden sheet, a thin non-woven cloth, Japanese paper or a carbon sheet is adhered to make an adhered sheet, and the adhered sheet is impregnated with thermosetting resin. Then, the adhered sheet is hot press molded to be made into an approximately horn shape.

With respect to a wooden speaker diaphragm, it is a key to deal with the characteristics of wood, which is a basis material that easily cracks, the poor moldability thereof, and the deterioration thereof with age.

In above-mentioned Patent Document 1, a manufacturing method of molding and making the diaphragm into an approximately horn shape (or cone shape) is not described, since the diaphragm is a flat diaphragm. In the manufacturing methods of Patent Document 2 shown in FIGS. 1A and 1B and FIGS. 2A and 2B, respectively, the wooden sheet 1 and the small wooden pieces 2*a* to 2L are molded while the characteristics of the wood are maintained as they are. Therefore, cracks may occur upon handling or press molding of the wooden sheets. Moreover, since the wooden sheets are adhered to each other with an adhesive, there are problems that desired sound characteristics cannot be obtained and accuracy in dimensions cannot be secured because the adhered portions become obstacles.

As for the method described in Patent Document 3, in which a plurality of extremely thin wooden sheets are stacked and press molded, accurate processing thereof is rather difficult. Moreover, since there are more adhesive layers, the weight of the diaphragm itself becomes heavier due to the weight of the adhesive. As a consequent, desired sound characteristics cannot be obtained. The great amount of adhesive imposes adverse effects on the sound pressure frequency characteristics. Therefore, the method is not preferable.

In the manufacturing method described in Patent Document 4, a boiling process using hot steam or an alkaline solution of pH 10 or more is included. This method removes even lignin, a constituent material in the wood. As a result, characteristics intrinsic to the wood cannot be exhibited, which imposes adverse effects on the sound quality.

Above all, in the manufacturing methods described in Patent Documents 2 to 4, defects such as cracks, chaps and wrinkles are often generated. Therefore, in considering the mass production of the diaphragms, yield of thereof is extremely poor. Thus commercialization thereof have not been realized.

The manufacturing methods described in Patent Documents 5 and 6 are more suitable than those in Patent Documents 2 to 4 in terms of mass production. However, it cannot be said that a manufacturing method which offers sufficient moldability and excellent mass productivity has been accomplished. Accordingly, further improvement in moldability, realization of beautifully finished wooden diaphragms, and establishment of mass productivity are desired in order to commercialize the wooden diaphragms.

SUMMARY OF THE INVENTION

The present invention is made in view of the foregoing problems. An object of the present invention is to provide wooden speaker diaphragms which are extremely effective in improving sound characteristics of an audio speaker. It is another object to provide manufacturing methods of wooden speaker diaphragms which have sufficient moldability and mass productivity. It is still another object to provide dynamic speakers having wooden speaker diaphragms which are extremely effective in improving sound characteristics.

In order to solve the foregoing problems, the present invention provides a speaker diaphragm in an approximately horn shape made up of a piece of wooden sheet, in which: a cloth or paper is adhered on one surface of the wooden sheet; an adhered sheet including the wooden sheet and the cloth or paper is made into an approximately horn shape by overlapping edge portions of an approximately V-shaped notch formed in advance; a constituent material of a moisture-retaining material which is impregnated when forming the adhered sheet into the approximately horn shape is remained inside the adhered sheet; the edge portions of the approximately V-shaped notch of the adhered sheet are adhered with thermosetting resin, and the thermosetting resin is attached over entire front and back surfaces of the adhered sheet; and a moisture-proof agent is applied to cover the thermosetting resin on the entire front and back surfaces of the adhered sheet.

Here, it is preferable that the cloth or paper is adhered on the wooden sheet such that a direction of a fiber of the cloth or paper is approximately perpendicular to a grain direction of the wooden sheet.

It is preferable that a midline of the approximately V-shaped notch is provided to be generally along the grain direction of the wooden sheet.

It is preferable that the wooden sheet is cut out from solid wood of which a sound wave velocity in the grain direction is in a range from 4.5 to 6.0 km/second and an internal coefficient is in a range from 0.02 to 0.03.

It is preferable that a thickness of the wooden sheet is 0.1 to 0.9 mm.

Moreover, provided is a dynamic speaker including an approximately horn-shaped speaker diaphragm of a piece of wooden sheet, and an approximately dome-shaped cap covering a center hole formed in a center portion of the speaker diaphragm, in which: a cloth or paper is adhered on one surface of the wooden sheet; an adhered sheet including the wooden sheet and the cloth or paper is made into an approximately horn shape by overlapping edge portions of an approximately V-shaped notch formed in advance; a constituent material of a moisture-retaining material which is impregnated when forming the adhered sheet into the approximately horn shape is remained inside the adhered sheet; the edge portions of the approximately V-shaped notch of the adhered sheet are adhered with thermosetting resin, and the thermosetting resin is attached over entire front and back surfaces of the adhered sheet; and a moisture-proof agent is applied to cover the thermosetting resin on the entire front and back surfaces of the adhered sheet.

Here, it is preferable that the cloth or paper is adhered on the wooden sheet such that a direction of a fiber of the cloth or paper is approximately perpendicular to a grain direction of the wooden sheet.

It is preferable that a midline of the approximately V-shaped notch is provided to be generally along the grain direction of the wooden sheet.

It is preferable that the wooden sheet is cut out from solid wood of which a sound wave velocity in the grain direction is in a range from 4.5 to 6.0 km/second and an internal coefficient is in a range from 0.02 to 0.03.

It is preferable that a thickness of the wooden sheet is 0.1 to 0.9 mm.

Furthermore, provided is a manufacturing method of a speaker diaphragm where a speaker diaphragm is manufactured from a piece of wooden sheet, which includes: a lubricant impregnating step of wetting and softening the wooden sheet, and impregnating a lubricant which acts to keep water in the wooden sheet; a first pressing step of tentatively molding the wooden sheet in a predetermined shape; a first drying step of drying the wooden sheet tentatively molded in the predetermined shape; a thermosetting resin impregnating step of impregnating thermosetting resin into the wooden sheet dried in the first drying step; a half-drying step of half-drying the wooden sheet impregnated with the thermosetting resin; a second pressing step of molding the wooden sheet half-dried in the half-drying step in a predetermined shape by heating and pressing; and a moisture-proof agent applying step of applying a moisture-proof agent to the wooden sheet molded in the predetermined shape.

It is preferable that, prior to the lubricant impregnating step, an adhering step of adhering a cloth or paper on one surface of the wooden sheet to make the wooden sheet to be an adhered sheet in advance is further included.

It is preferable that, when the predetermined shape is an approximately horn shape, a notch cutting step of forming an approximately V-shaped notch on the wooden sheet/adhered sheet is further included prior to the lubricant impregnating step, that edge portions of the notch of the wooden sheet/adhered sheet are overlapped, heated and pressed to tentatively mold the wooden sheet/adhered sheet in the approximately horn shape in the first pressing step, and that a center and periphery removing step of removing a center hole for a voice coil and a periphery from the wooden sheet/adhered sheet molded in the approximately horn shape to form a speaker diaphragm having a predetermined dimension and shape is further included after the moisture-proof agent applying step.

It is preferable that, prior to the first pressing step, further included is a latching and keeping step of latching, with a latching tool, a portion outside an area to be press molded in the first pressing step such that the wooden sheet/adhered sheet is latched and kept in the approximately horn shape while the edge portions of the notch of the wooden sheet/adhered sheet are overlapped.

It is preferable that, when the approximately V-shaped notch is formed on the wooden sheet/adhered sheet in the notch cutting step, an engagement latch mechanism which is used for engaging the edge portions of the notch of the wooden sheet/adhered sheet and is integrated with the wooden sheet is formed, and, prior to the first pressing step, the edge portions of the notch are engaged by the engagement latch mechanism such that the wooden sheet/adhered sheet is latched and kept in the approximately horn shape while the edge portions of the notch of the wooden sheet/adhered sheet are overlapped.

It is preferable that a release agent impregnating step of impregnating a release agent into the wooden sheet/adhered sheet, a second drying step of drying the wooden sheet/adhered sheet impregnated with the release agent, and a third pressing step of heating and pressing the wooden sheet/adhered sheet dried in the second drying step to mold in a predetermined shape are provided between the second pressing step and the moisture-proof agent applying step.

It is preferable that, after the half-drying step, a weight evaluating step of measuring a weight of the half-dried wooden sheet/adhered sheet and returning the wooden sheet/adhered sheet of which the weight is below a designated range to the thermosetting impregnating step is further included.

It is preferable that, after the second pressing step, a propagation velocity evaluating step of measuring a sound wave velocity of the wooden sheet/adhered sheet and returning the wooden sheet/adhered sheet of which the propagation velocity is below a designated velocity to the second pressing step is further included.

The nature, principle and utility of the invention will become more apparent from the following detailed description when read in conjunction with the accompanying drawings.

DESCRIPTION OF THE PREFERRED EMBODIMENTS

Speaker diaphragms, manufacturing methods of the same, and dynamic speakers according to the present invention will be described with reference to the accompanying drawings.

First Embodiment

Figure 1A:
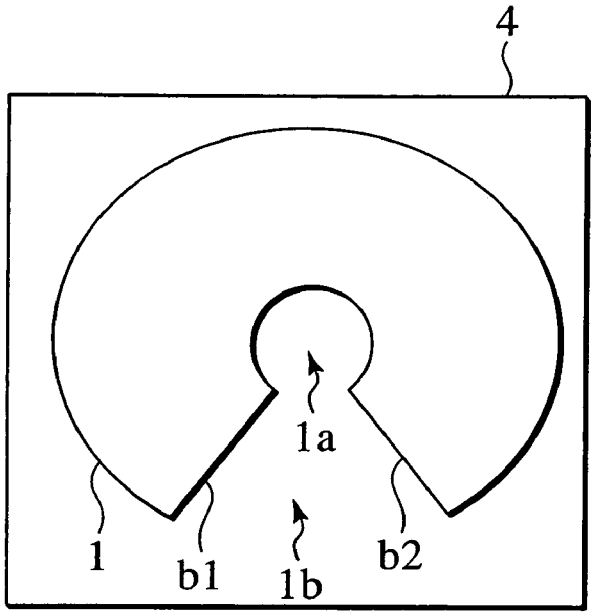
FIG.1A PRIOR ART
FIG. 1A is a view showing a manufacturing method of a conventional wooden diaphragm.
Figure 1B:
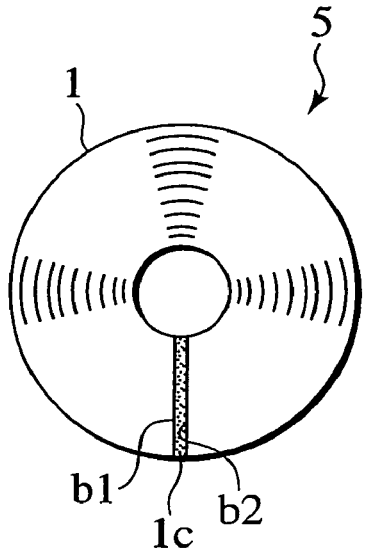
FIG.1B PRIOR ART
FIG. 1B is a plan view showing the conventional wooden diaphragm.
Figure 2A:
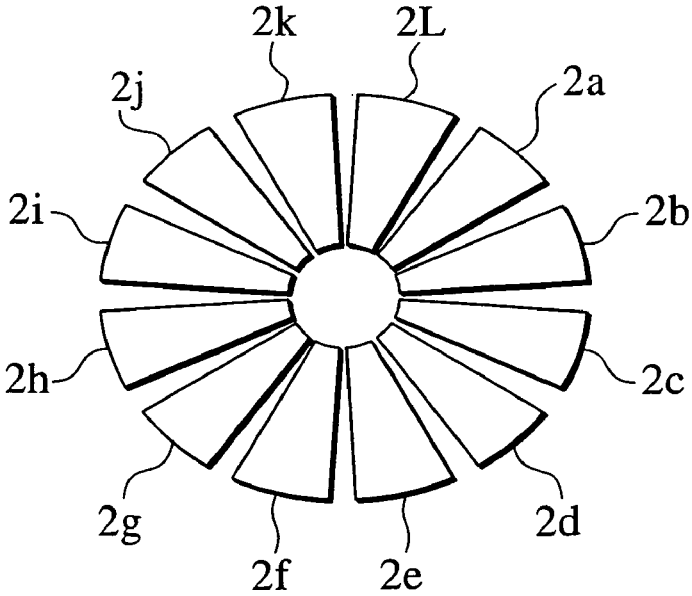
FIG.2A PRIOR ART
FIG. 2A is a view showing a manufacturing method of another conventional wooden diaphragm.
Figure 2B:
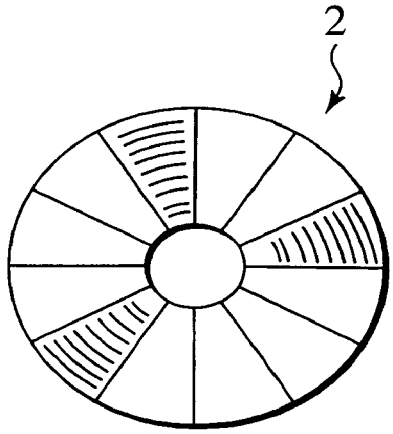
FIG.2B PRIOR ART
FIG. 2B is a plan view showing the another conventional wooden diaphragm.
Figure 3A:
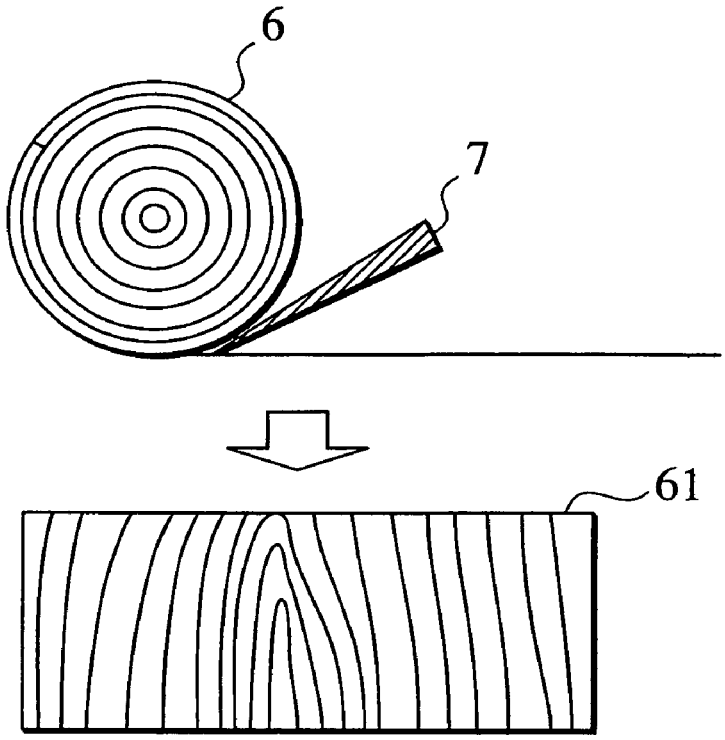
FIG. 3A is a view showing a manufacturing process of a wooden sheet used in the present invention.
Figure 3B:
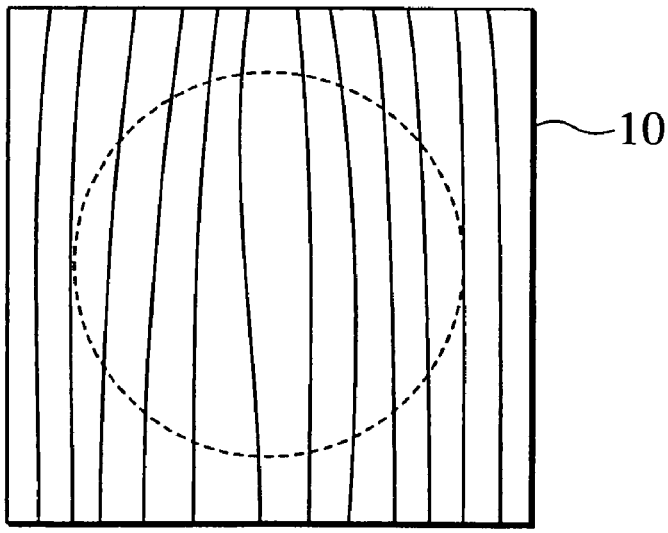
FIG. 3B is a plan view showing the wooden sheet used in the present invention.

First, as a preparatory step for speaker diaphragm manufacturing, as shown in FIG. 3A, a log 6, material wood for the speaker diaphragm, is thinly peeled along the circumference thereof with a peeling knife 7 by the rotary method to produce a wooden sheet 61. The wooden sheet 61 is cut into a suitable shape and size larger than a molding portion, which will be made into an actual diaphragm, and a wooden sheet 10 with large straight grain is formed as shown in FIG. 3B. Here, the wooden sheet 10 in FIG. 3B is an enlarged view of a part of the wooden sheet 61 in FIG. 3A. The dashed-line circle portion in the wooden sheet 10 is the molding portion to be made into the actual diaphragm. For example, in a case of a speaker diaphragm with a bore diameter of about 8 cm, a square or a rectangle having a side of about 12 to 14 cm, or a circle having a diameter of about 12 cm will be employed.

Next, a manufacturing method according to a first. embodiment will be described using FIGS. 4 to 6. The flow from (a1) to (j1) in (A) of FIG. 4 corresponds to processes (a1) to (f1) in FIG. 5 and to processes from (g1) to (j1) in FIG. 6. The manufacturing method according to the first embodiment includes ten steps from (a1) to (j1) performed after a producing step (p) of the wooden sheet 10, which is the basis material preparation step described in FIGS. 3A and 3B. An adhering step (a1), a notch cutting step (b1), a lubricant impregnating step (c1), a first pressing step (d1), a drying step (e1) a thermosetting resin impregnating step (f1) a half-drying step (g1), a second pressing step (h1), a moisture-proof agent applying step (i1), and a center and periphery removing step (j1) are sequentially performed to form a speaker diaphragm 30 as shown in FIG. 7.

Hereinbelow, details of the respective steps will be described in order using FIGS. 5 and 6. In FIG. 5, on one surface of the wooden sheet 10 with a thickness of 0.1 to 0.9 mm (preferably around 0.3 mm), a thin cloth or paper 13 with a thickness of approximately 0.02. to 0.30 mm is adhered with an adhesive to produce an adhered sheet 15 in an approximately square shape (adhering step (a1)). A non-woven cloth is suitable for such a cloth. Here, the non-woven cloth is made of, for example, a carbon material or other synthetic resin, in which fibers are made into a cloth as they are, not by knitting, weaving or the like. Japanese paper is suitable for the above paper.

When the directions of the fibers of the cloth or paper 13 are generally in one direction, it is preferable that the directions of the fibers of the cloth or paper 13 are approximately perpendicular to the direction of the grain (arrow f) of the wooden sheet 10. The strength of the wooden sheet 10, which is easy to crack, can then be dramatically improved.

The surface of the adhered sheet 15 on which the cloth or paper 13 is adhered is to be the back surface of the finished speaker diaphragm 30. The above thickness of the wooden sheet 10 is an appropriate thickness for a speaker diaphragm in consideration of moldability, sound characteristics and a bore diameter of a dynamic speaker.

Then, to the adhered sheet 15, there are provided an approximately V-shaped notch 11 whose summit is in the center portion of the adhered sheet 15, and an aperture 12 in the vicinity of the summit (notch cutting step (b1)). By providing the aperture 12 before forming the notch 11, occurrence of cracks in the vicinity of the summit can be prevented when forming the notch 11. The shape of the aperture 12 is not limited, and may be a circle, an oval, a hexagon or the like with a diameter of several mm. Note that the notch 11 is provided such that a midline m thereof is generally along the direction of the grain (arrow f) of the adhered sheet 15.

Thereafter, the adhered sheet 15, on which the notch 11 and the aperture 12 are formed, is wetted to be softened, and is impregnated with a lubricant 16 which acts to keep water in the adhered sheet 15 (lubricant impregnating step (c1)). For example, the adhered sheet 15 is soaked, for 5 to 60 minutes, in a liquid of the lubricant 16 collected in a container 16*c* so that the lubricant 16 is sufficiently impregnated thereinto. This is intended to prevent cracks of the sheets in the first hot press molding to be performed later, and to tentatively mold the sheets with high yield.

The study by the inventor has made it clear that an aqueous solution in which saccharides are dissolved, rather than mere water or an aqueous alkali solution, is effective in improving the moldability as the lubricant 16. Moreover, an aqueous solution containing at least one of saccharides, glycerin and amino acids is effective as the lubricant 16. A preferred example of the lubricant 16 containing such a component is Japanese sake.

Subsequently, while edge portions 11*a* and 11*b* of the approximately V-shaped notch 11 are overlapped with each other, the adhered sheet 15 impregnated with the lubricant 16 is tentatively molded in an approximately horn shape using a press device P1, which is a metal mold made up of an upper mold 31 and a lower mold 32 each having heaters 33, by the first hot press molding (first pressing step (d1) The lower mold 32 includes a projecting pin 321, and the upper mold 31 includes a recess 311 to engage with the projecting pin 321. In the first pressing step (d1) the aperture 12 provided in the center of the adhered sheet 15 is placed such that the projecting pin 321 is inserted therein, whereby the position of the adhered sheet 15 with respect to the lower mold 32 can be determined. The position of the upper mold 31 with respect to the lower mold 32 can also be determined by engaging the recess 311 with the projecting pin 321. Accordingly, workability of the hot press molding and positioning accuracy in molding of the adhered sheet 15 are increased, thereby improving mass production efficiency and yield thereof.

Here, preferred set conditions for the first hot press molding are a press pressure of approximately 1 to 10 kg, metal mold temperatures of approximately 80 to 150° C. for the upper mold 31 and approximately 100 to 200° C. for the lower mold 32, and a press time of approximately 2 to 60 seconds. Since the lubricant 16, a moisture-retaining material, is impregnated in the adhered sheet 15, the adhered sheet 15 does not completely get dried by the first hot press molding.

Thereafter, the tentatively molded adhered sheet 15 is put into a drying furnace (50 to 60° C.), which is not shown, for approximately 10 to 30 minutes to be completely dried (drying step (e1)). At this time, components of the lubricant 16, a moisture-retaining material, remains inside the adhered sheet 15.

Then, the dried adhered sheet 15 is impregnated with thermosetting resin 17 (thermosetting resin impregnating step (f1)). For example, the adhered sheet 15 is soaked, for approximately 30 to 180 minutes, in a liquid of the thermosetting resin 17 collected in a container 17*c* so that the thermosetting resin 17 is sufficiently impregnated thereinto. Phenolic resin is suitable as the thermosetting resin 17.

Figure 6:
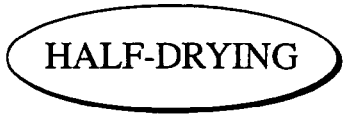
FIG. 6 is a view showing in detail the manufacturing method according to the first embodiment.
Figure 6:
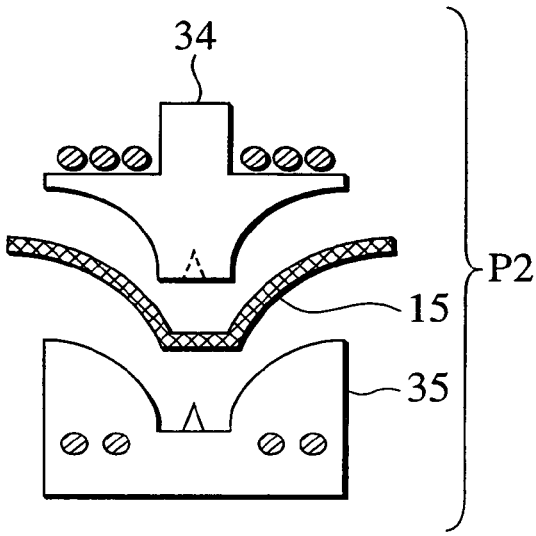
Figure 6:
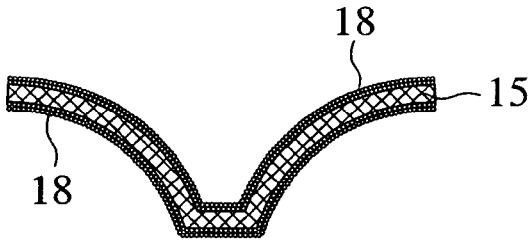
Figure 6:
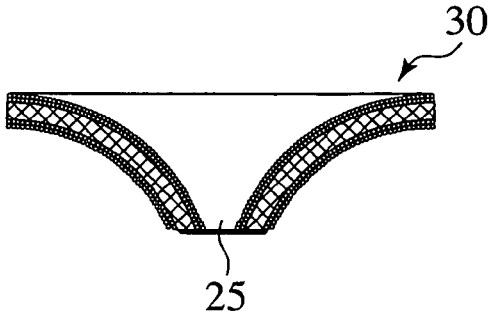
Figure 7:
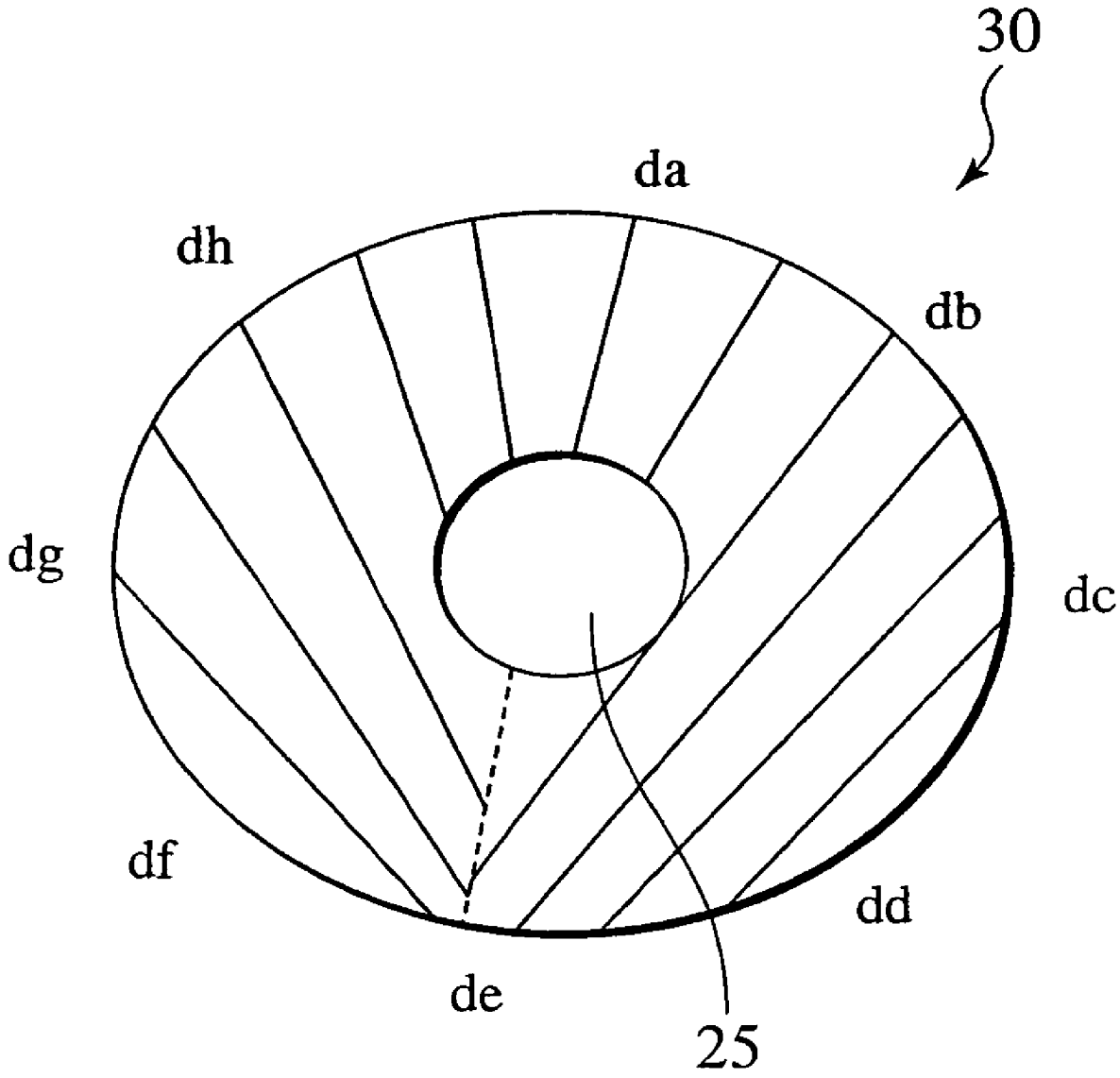
FIG. 7 is a plan view showing a speaker diaphragm produced by the manufacturing method according to the first embodiment.

In FIG. 6, the adhered sheet 15 impregnated with the thermosetting resin 17 is put into a drying furnace (50 to 60° C.), which is not shown, for approximately 1 to 10 minutes to half-dry the thermosetting resin 17 (half-drying step (g1)). The half-dry state is a so-called "dry to touch state," where the thermosetting resin 17 does not have a sticky touch. Note that, if the second pressing step, which is the subsequent step, is performed immediately after the thermosetting resin 17 is impregnated, the thermosetting resin 17 will stick to the metal mold. Accordingly, the adhered sheet 15 will get cracks and torn when peeled off after pressed, which results in an extreme decrease in the yield thereof. In contrast, if the thermosetting resin 17 is completely dried, the moldability of the adhered sheet 15 is deteriorated, and cracks easily occur. The adhered sheet 15 will have almost no cracks in the second hot press molding, which is the subsequent step, by half-drying the thermosetting resin 17. Thus, the yield thereof can be significantly improved.

Then, using a press device P2 having a similar structure to that in the first pressing step (d1), the adhered sheet 15 with the half-dried thermosetting resin 17 is hot press molded again (second pressing step (h1)). Here, preferred set conditions for the second hot press molding are a press pressure of approximately 20 to 40 kg, metal mold temperatures of approximately 80 to 200° C. for an upper mold 34 and approximately 100 to 200° C. for a lower mold 35, and a press time of approximately 10 to 100 seconds.

After the second hot press molding, volatile components are evaporated, and the adhered sheet 15 is molded to be a stable, approximately horn shape. Note that, the overlapping portion of the edge portions 11*a* and 11*b* of the approximately V-shaped notch 11 in the adhered sheet 15 is adhered by curing of the thermosetting resin 17, and closely adhered and molded by press molding so that unevenness thereof almost cannot be recognized. Moreover, the thermosetting resin 17 is attached over the front and back surfaces of the adhered sheet 15.

Furthermore, a moisture-proof agent 18 is applied, with a brush or by immersing thereinto, to the front and back surfaces of the adhered sheet 15 after the second hot press molding, and then dried naturally or completely dried in a drying furnace (moisture-proof agent applying step (i1)). The moisture-proof agent 18 will then cover the entire front and back surfaces of the adhered sheet 15, which is already covered with the thermosetting resin 17. A compound of polyisocyanate and polyester polyol, for example, is used as the moisture-proof agent 18. Application of the moisture-proof agent 18 will allow the adhered sheet 15 to be a speaker diaphragm that has small deterioration with age attributable to humidity and thus has excellent durability.

Lastly, a center hole 25 for a voice coil and the periphery of the adhered sheet 15 on which the moisture-proof agent 18 is applied are removed, whereby the speaker diaphragm 30, which is a diaphragm determined to have a predetermined dimension, is completed (center and periphery removing step (j1)).

As shown in FIG. 7, in the speaker diaphragm 30 thus manufactured, as for radial directions from the center hole 25 pierced for the voice coil (for example, da to dh directions), only the da direction lies along the grain direction. Each of the other directions intersects with the grain at a certain angle. Hence, sound wave velocities are not the same in most directions, standing waves are not generated normally, and resonance points hardly occur. Thus, split vibrations can be suppressed.

Moreover, the speaker diaphragm 30 includes excellent sound characteristics based on the fact that the speaker diaphragm 30 is made of wood. In addition, due to the impregnation of the lubricant and the thermosetting resin, the application of the moisture-proof agent, the schemes in the series of hot press molding steps, etc., the speaker diaphragm 30 has small deterioration with time against humidity, a long life, and a beautiful wood-grained finish. It is noteworthy that, although the manufacturing process thereof is simple, the yield thereof is extremely good, and the mass productivity is excellent while the manufacturing costs are suppressed.

Figure 8:
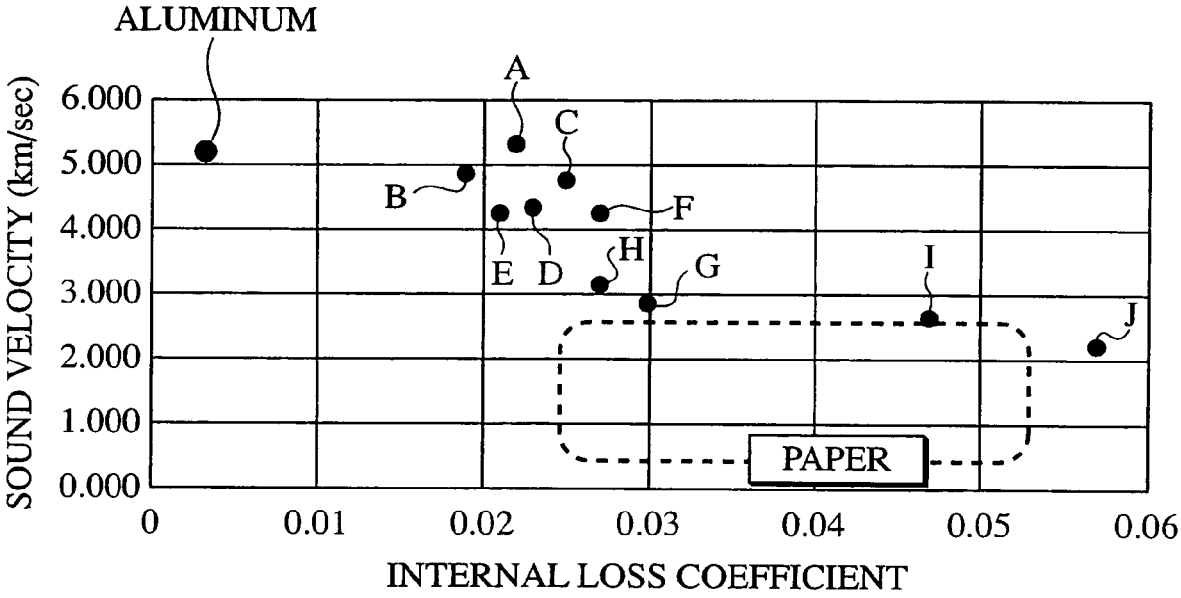
FIG. 8 is a characteristic plot showing relationships between internal loss coefficients of respective materials and sound wave velocities (longitudinal direction)

Here, wood that is suitable as the material for the speaker diaphragm is considered. FIG. 8 is a graph showing the relationships between internal loss coefficients of respective kinds of wood and sound wave velocities (longitudinal direction) together with aluminum and paper, which are conventional materials therefor. Table 1 below shows densities, Young's moduli, sound velocities, and internal loss coefficients (tan ,,) of the respective kinds of wood. From FIG. 8 and Table 1, it is clear that, while plywood (Points G, H, I and J) cannot, solid wood can generally be an excellent material having an appropriate internal loss coefficient and a high sound wave velocity. In particular, it is clear that birch (Point A) and beech (Point C) are most suitable.

Note that Point A in FIG. 8 is birch (solid wood), and others are as follows: Point B is linden (solid wood); Point C is beech (solid wood); Point D is oak (solid wood); Point E is cherrywood (solid wood); Point F is spruce (solid wood); Point G is linden plywood (concentric); Point H is lauan plywood; Point I is Medium Density Fiberboard (MDF); and Point J is particle board.

TABLE 1

| Name of Material | Density (kg/m$^3$) | Young's Modulus (×109 pa) | Sound Velocity (km/sec) | tan,, |
|---|---|---|---|---|
| Birch | 784.3 | 19.917 | 5.039 | 0.022 |
| Linden | 407.3 | 9.761 | 4.896 | 0.019 |

TABLE 1-continued

| Name of Material | Density (kg/m³) | Young's Modulus (×109 pa) | Sound Velocity (km/sec) | tan" |
|---|---|---|---|---|
| Beech | 690.7 | 15.49 | 4.736 | 0.025 |
| Oak | 684.7 | 12.687 | 4.305 | 0.023 |
| Cherrywood | 551.4 | 9.994 | 4.258 | 0.021 |
| Spruce | 345.4 | 6.25 | 4.254 | 0.027 |
| Linden | 539.3 | 4.448 | 2.872 | 0.03 |
| Plywood | | | | |
| Lauan | 635.7 | 6.368 | 3.165 | 0.027 |
| Plywood | | | | |
| MDF | 797.2 | 5.604 | 2.651 | 0.047 |
| Particle Board | 750.6 | 3.642 | 2.203 | 0.057 |

Figure 4:
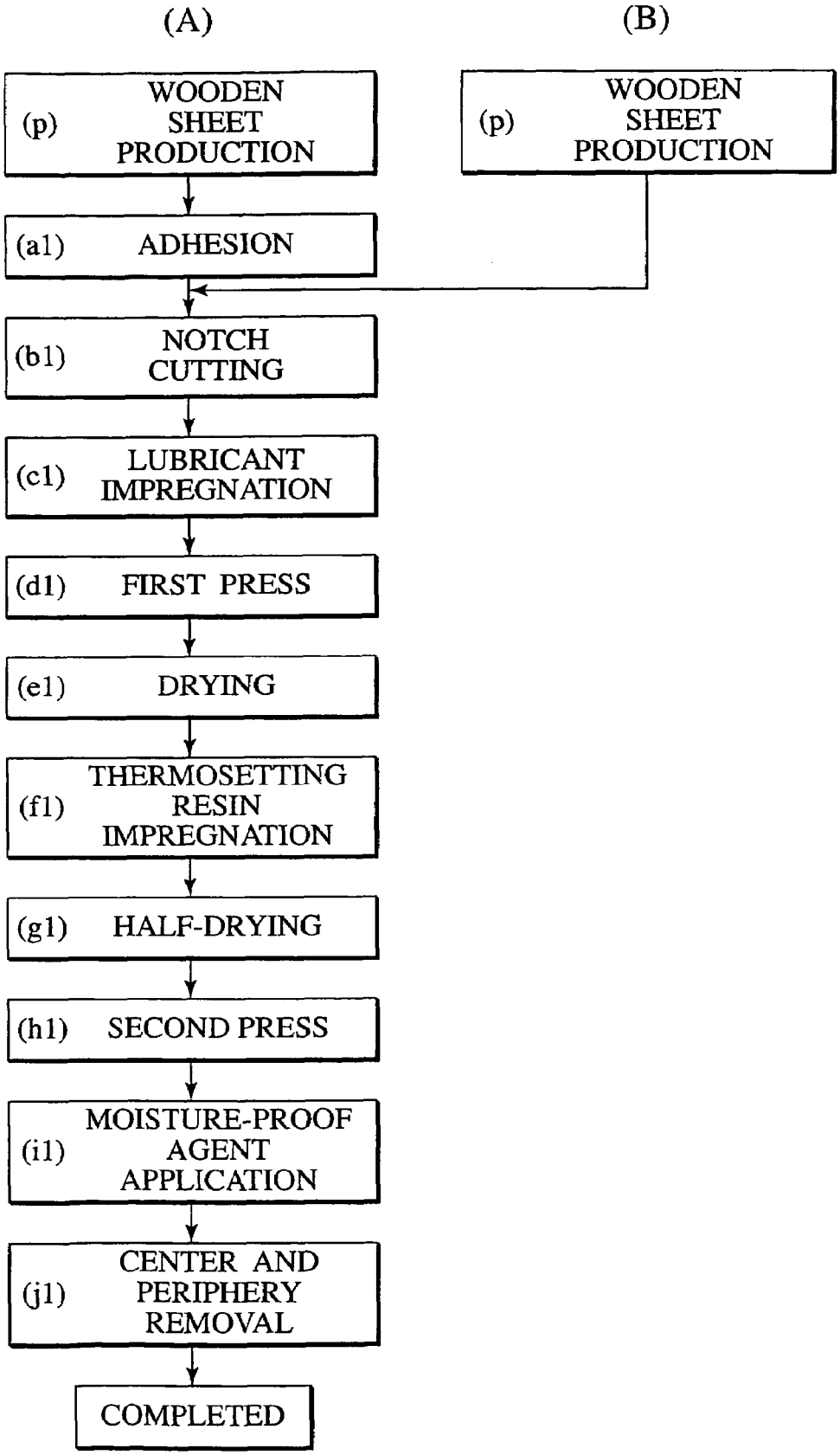
FIG. 4 is a flow diagram showing a manufacturing method according to a first embodiment.

(B) in FIG. 4 is a modified example of the manufacturing method according to the first embodiment, in which the adhering step (a1) in (A) of FIG. 4 is omitted. In other words, the cloth or paper 13 is not adhered to one surface of the wooden sheet 10, and the above-described respective steps from the notch cutting step (b1) to the center and periphery removing step (j1) are performed on the wooden sheet 10 as it is. Although the cloth or paper 13 is not adhered on one surface of the wooden sheet 10, the speaker diaphragm can be formed.

However, the wooden sheet 10 with a thickness of approximately 0.1 to 0.9 mm very easily cracks when handling. Therefore, it is preferable that the adhering step (a1) is performed in advance to reinforce the wooden sheet 10 with the cloth or paper 13.

Second Embodiment

A manufacturing method according to a second embodiment will be described with a focus on different points from the manufacturing method according to the first embodiment, and description of common points will be omitted as appropriate. A feature of the second embodiment is that, not only the cloth or paper 13 on one surface of the wooden sheet 10, but also a cloth or paper 13' is adhered in the center portion of the opposite side thereof in order to further prevent cracks caused upon the hot press molding and to improve strength of the neck portion around the center hole 25 for the voice coil of the diaphragm.

Figure 9A:
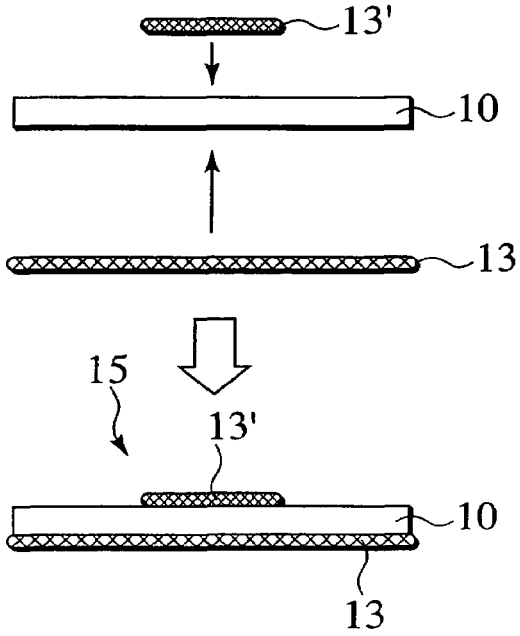
FIGS. 9A to 9D are views showing a manufacturing method according to a second embodiment.

That is, as shown in FIG. 9A, the cloth or paper 13 is adhered entirely on one surface (back surface) of the wooden sheet 10, and the cloth or paper 13', which is in a circular shape whose size is the same as or smaller than the bore size of a dust cap 36 (shown in FIG. 9D) and is larger than the center hole 25 (shown in FIG. 9C), is adhered with an adhesive in the center portion of the opposite surface (front surface) (adhering step (a2)). It is the same as the first embodiment that a non-woven cloth or Japanese paper is preferable as the cloth or paper 13'.

Figure 9B:
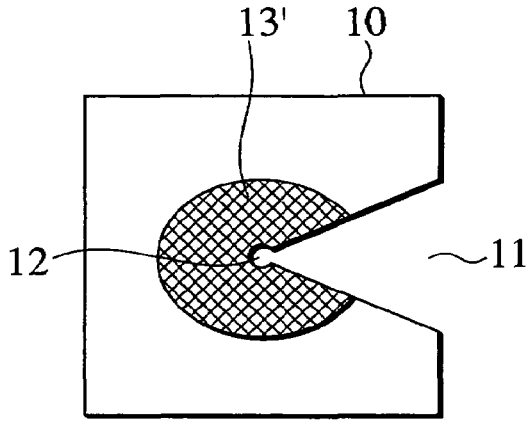
Figure 9C:
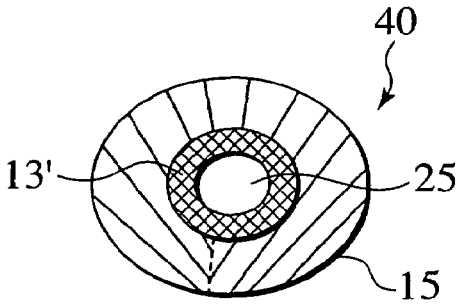
Figure 9D:
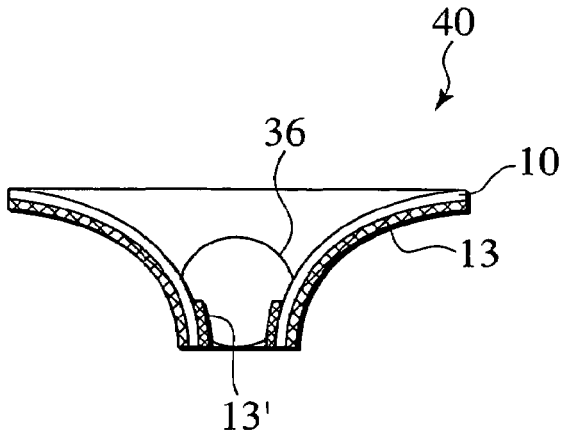

Thereafter, as shown in FIG. 9B, the approximately V-shaped notch 11 and the aperture 12 are provided (notch cutting step (b2)). Then, the respective steps from the lubricant impregnating step (c1) to the center and periphery removing step (j1) of FIG. 4 are performed. Consequently, as shown in FIG. 9C, a speaker diaphragm 40 is formed, whose neck portion around the center hole 25 for the voice coil, which has the greatest amplitude, is reinforced with the cloth or paper 13' on the front surface thereof. As seen from the cross-section in FIG. 9D, the cloth or paper 13' on the front surface is covered by the dust cap 36, and does not damage the external appearance.

Third Embodiment

A manufacturing method according to a third embodiment will be described with a focus on different points from the manufacturing method according to the first embodiment, and description of common points will be omitted as appropriate. The materials for the speaker diaphragms 30 and 40 according to the manufacturing methods of the first and second embodiments are anisotropic wood. Therefore, as described above, almost no split vibrations occur. In the third embodiment, a speaker diaphragm 50 with conical domes is formed in order to completely suppress split vibrations.

Figure 10A:
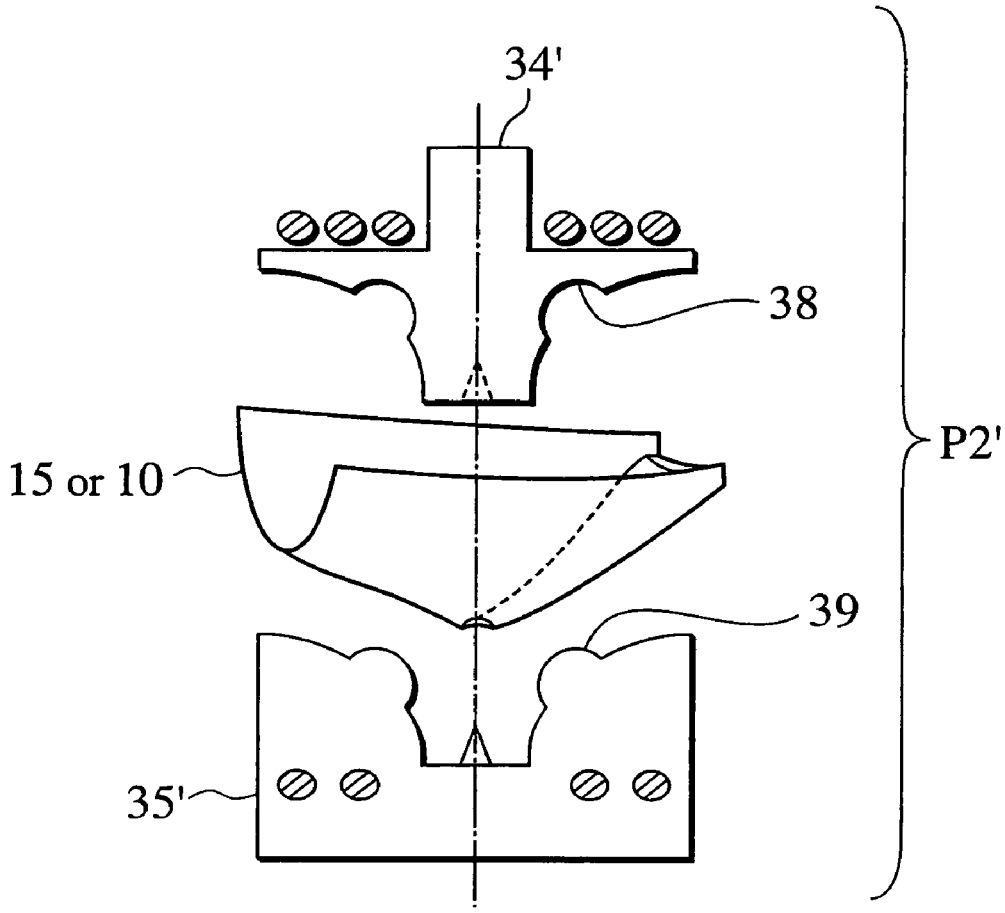
FIG. 10A is a view for describing a manufacturing method according to a third embodiment.

That is, as shown in FIG. 10A, upon the second hot press molding with a press device P2', the adhered sheet 15 or the wooden sheet 10 is hot press molded using an upper mold 34' having recessed portions 38 and a lower mold 35' having swollen portions 39 (second pressing step (h3)). The other steps are the same as those of the manufacturing method of the first embodiment.

Figure 10B:
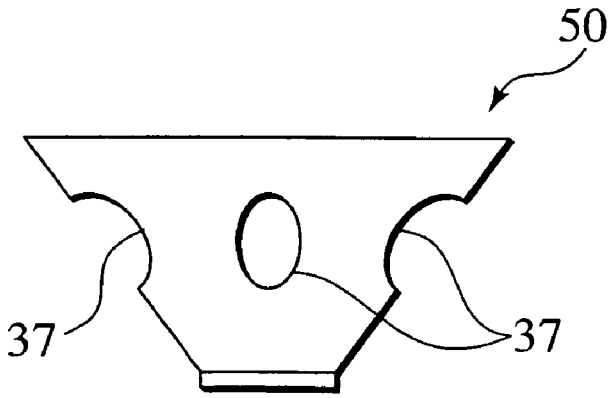
FIG. 10B is a side view showing a speaker diaphragm produced by the manufacturing method according to the third embodiment.

In this way, as shown in FIG. 10B, at the same time as the adhered sheet 15 or the wooden sheet 10 is molded and processed, the speaker diaphragm 50 having a plurality of conical domes 37 are formed by integral press molding. Thus, conical domes of separate members are unnecessary, and an adhering step of the conical domes of the separate members is also unnecessary. Therefore, the speaker diaphragm 50 with the conical domes can be manufactured inexpensively.

Fourth Embodiment

Figure 11:
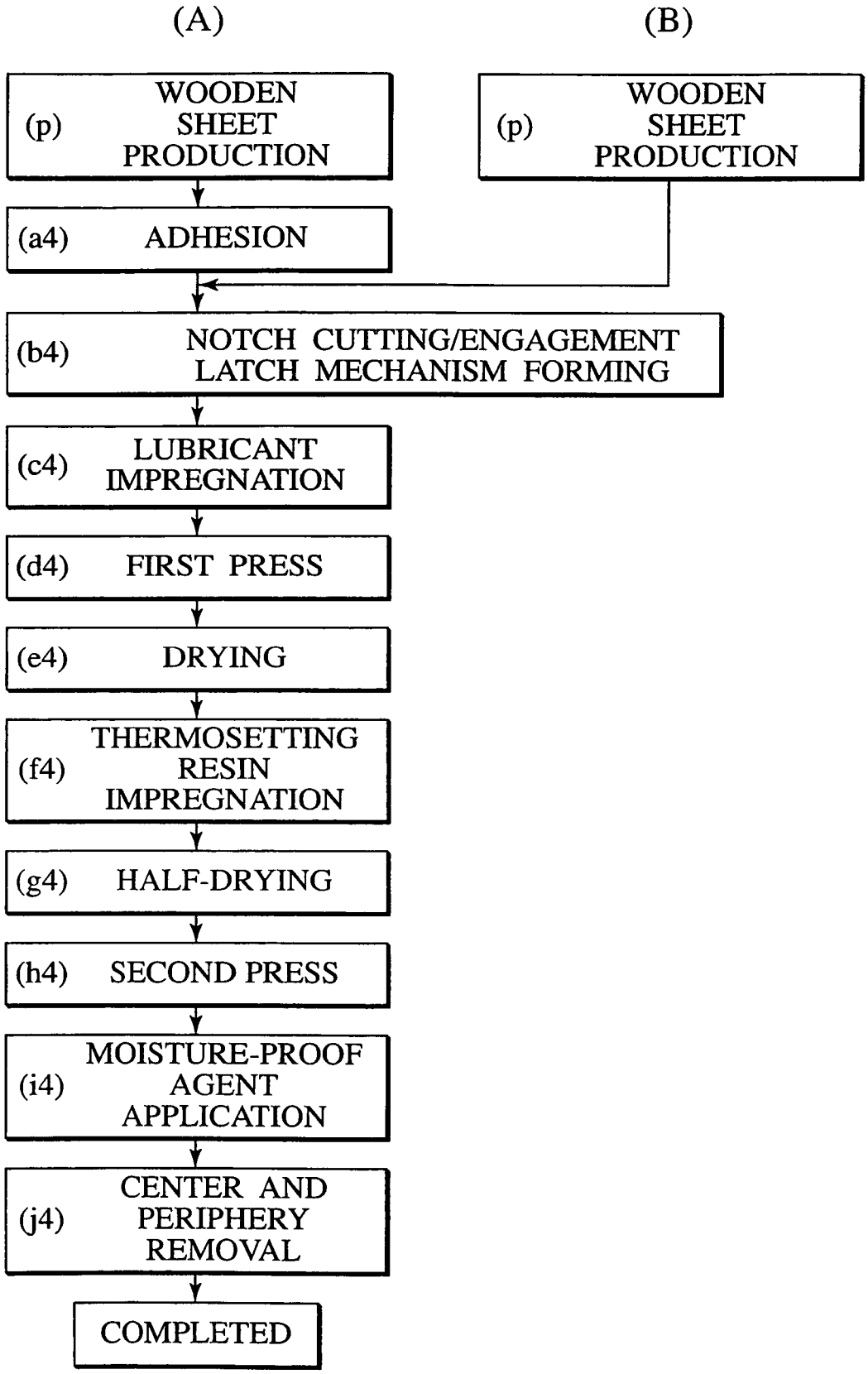
FIG. 11 is a flow diagram showing a manufacturing method according to a fourth embodiment.
Figure 12:
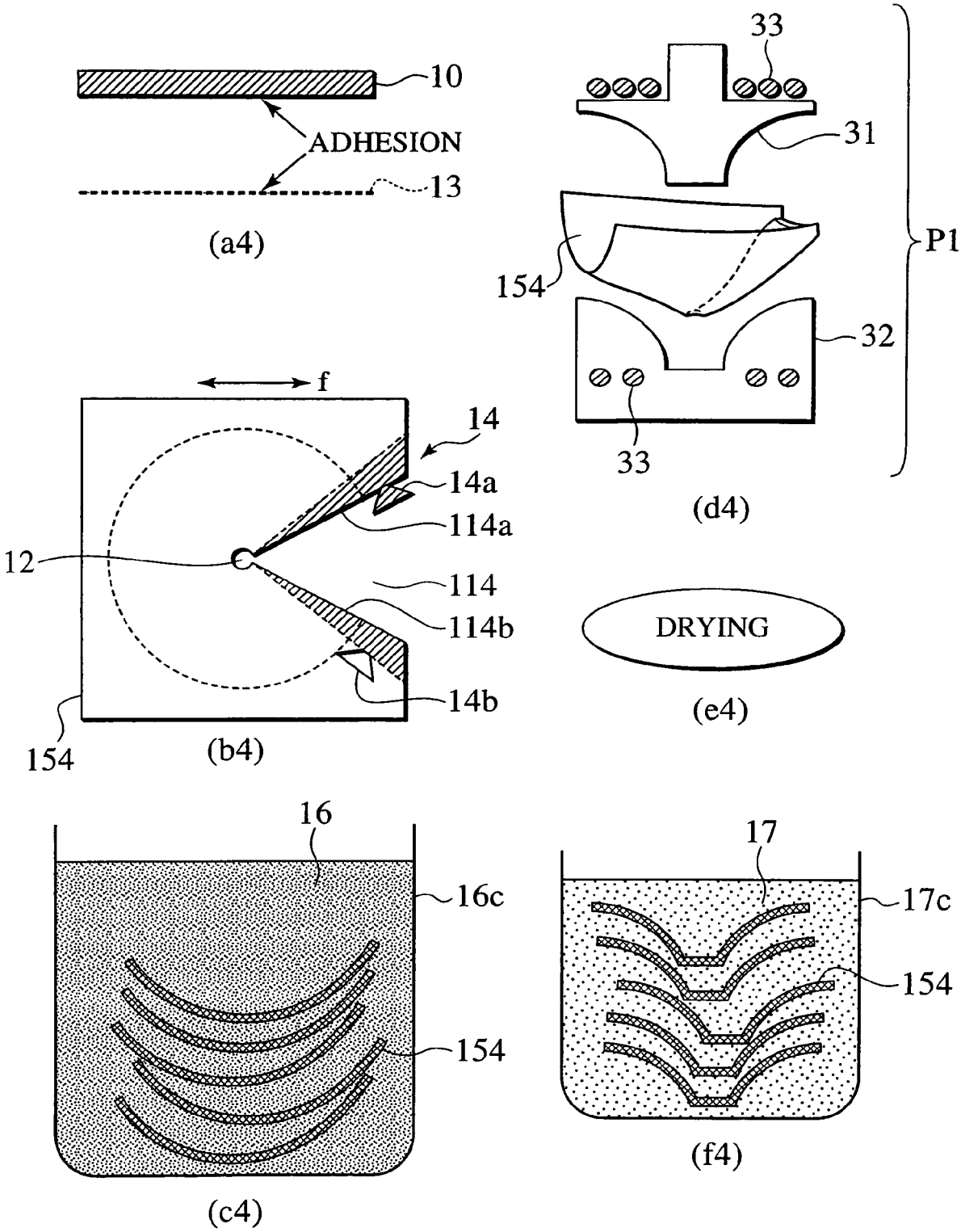
FIG. 12 is a view showing in detail the manufacturing method according to the fourth embodiment.
Figure 13:
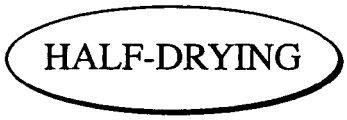
FIG. 13 is a view showing in detail the manufacturing method according to the fourth embodiment.
Figure 13:
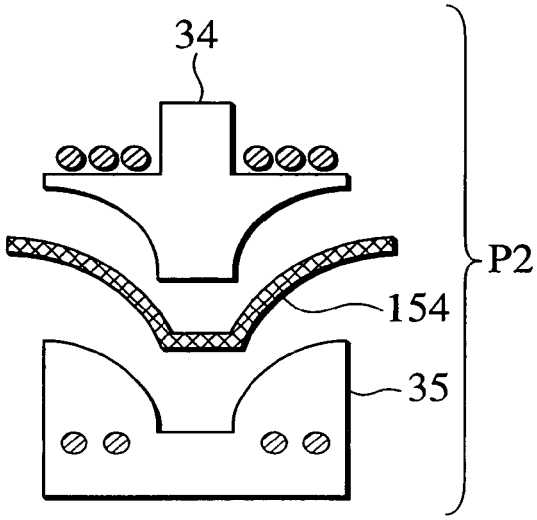
Figure 13:
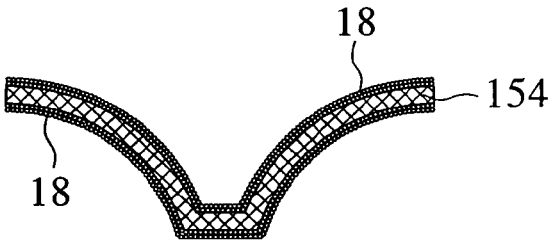
Figure 13:
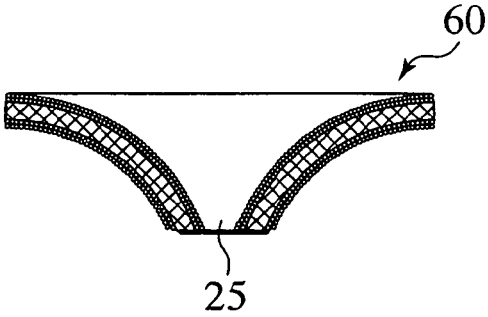
Figure 16:
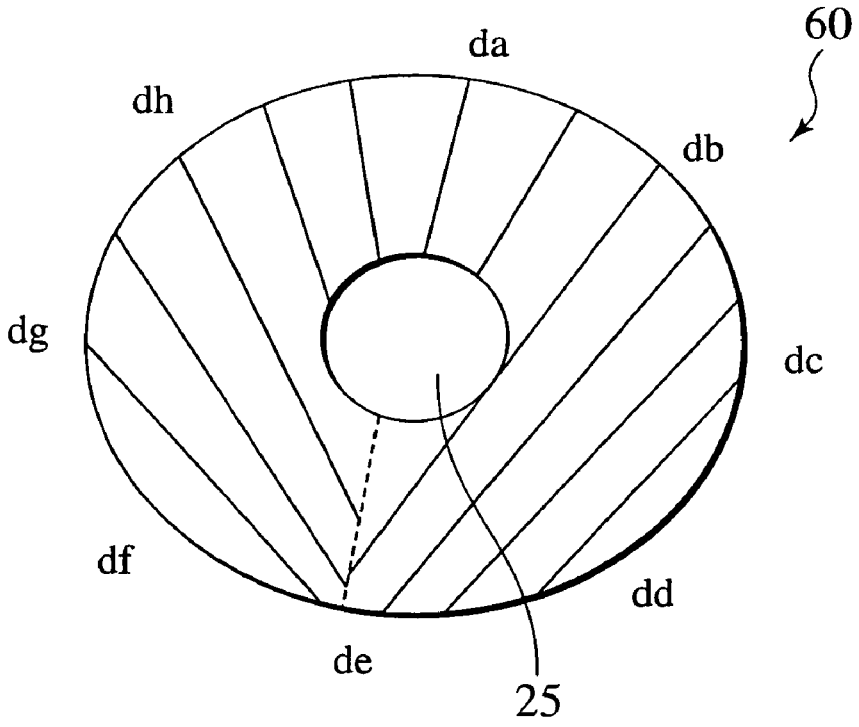
FIG. 16 is a side view showing a speaker diaphragm produced by the manufacturing method according to the fourth embodiment.

The flow from (a4) to (j4) in FIG. 11A corresponds to processes from (a4) to (f4) in FIG. 12 and processes from (g4) to (j4) in FIG. 13. A manufacturing method according to a fourth embodiment includes ten steps from (a4) to (j4) performed after the producing step (p) of the wooden sheet 10, which is the basis material preparation step described in FIGS. 3A and 3B. An adhering step (a4), a notch cutting/engagement latch mechanism forming step (b4), a lubricant impregnating step (c4), a first pressing step (d4), a drying step (e4), a thermosetting resin impregnating step (f4), a half-drying step (g4), a second pressing step (h4), a moisture-proof agent applying step (i4), and a center and periphery removing step (j1) are sequentially performed to form a speaker diaphragm 60 as shown in FIG. 16. A manufacturing method according to the fourth embodiment will be described with a focus on different points from the manufacturing method according to the first embodiment, and description of common points will be omitted as appropriate.

Figure 5:
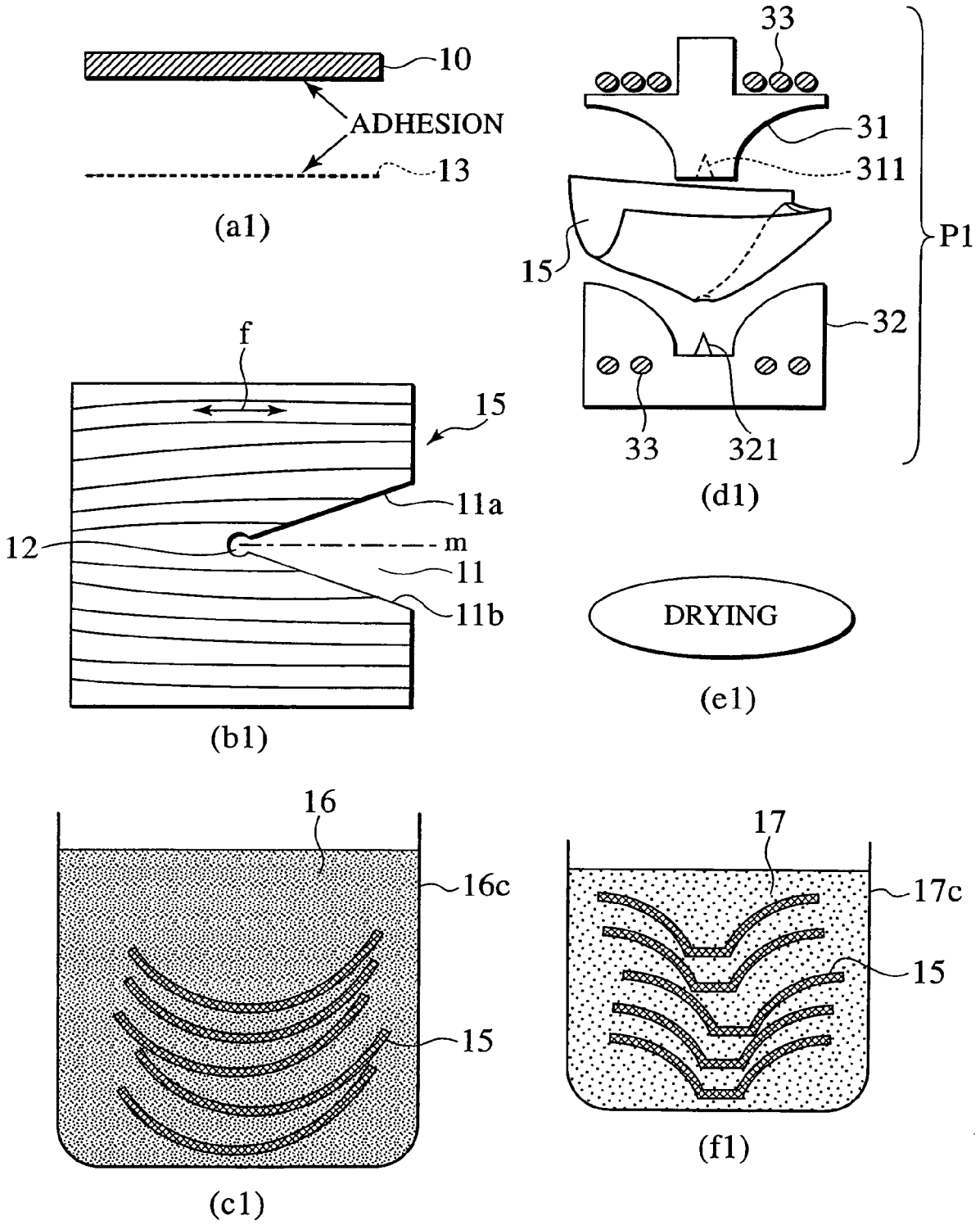
FIG. 5 is a view showing in detail the manufacturing method according to the first embodiment.

In FIG. 12, the adhering step (a4) is the same as the adhering step (a1) in FIG. 5. However, an adhered sheet formed in the adhering step (a4) is defined as an adhered sheet 154. To the adhered sheet 154, there are provided an approximately V-shaped notch 114 whose summit is in the center portion of the adhered sheet 154, an aperture 12 in the vicinity of the summit, and an engagement latch mechanism 14 where edge portions 114*a* and 114*b* (shaded areas) of the notch 114 are overlapped with each other so that the whole adhered sheet 154 is latched and kept in an approximately horn shape (notch cutting/engagement latch mechanism forming step (b4)).

Here, description will be made of the adhered sheet 154 having the engagement latch mechanism 14. The engagement latch mechanism 14 of the adhered sheet 154 shown in FIGS. 12 and 14A includes an projection portion 14*a*1 in an approximately triangle shape which is projecting from the edge portion 114*a* of the notch 114, and a cutout portion 14*b*1 in an approximately triangle shape provided in the vicinity of the edge portion 114*b* on the other side. The whole adhered sheet 154 can be latched and kept in an approximately horn shape as shown in FIG. 15 by inserting the projection portion 14*a*1 into the cutout portion 14*b*1.

Figure 14A:
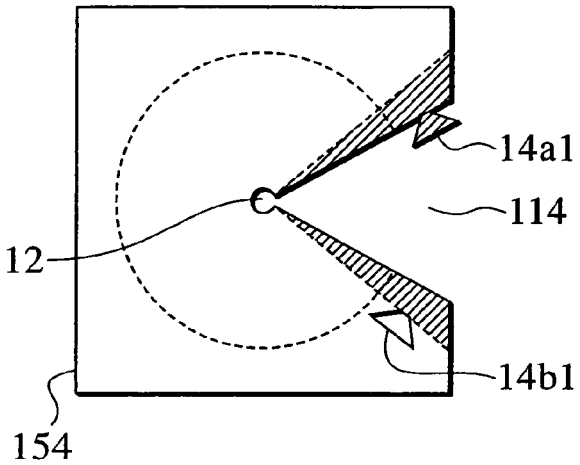
FIG. 14A is a plan view showing a first example of an engagement latch mechanism of the fourth embodiment.
Figure 14B:
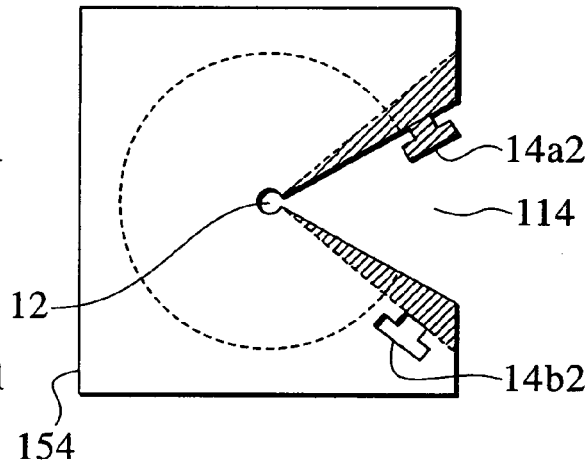
FIG. 14B is a plan view showing a second example of the engagement latch mechanism of the fourth embodiment.
Figure 14C:
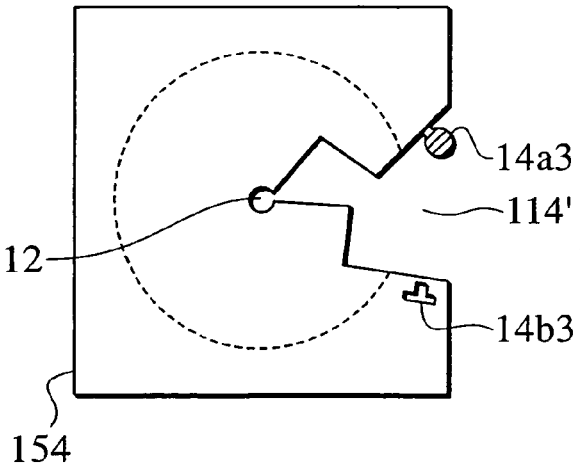
FIG. 14C is a plan view showing a third example of the engagement latch mechanism of the fourth embodiment.
Figure 14D:
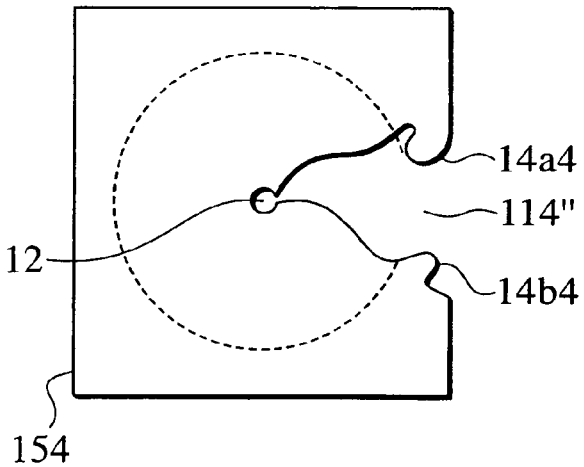
FIG. 14D is a plan view showing a fourth example of the engagement latch mechanism of the fourth embodiment.
Figure 15:
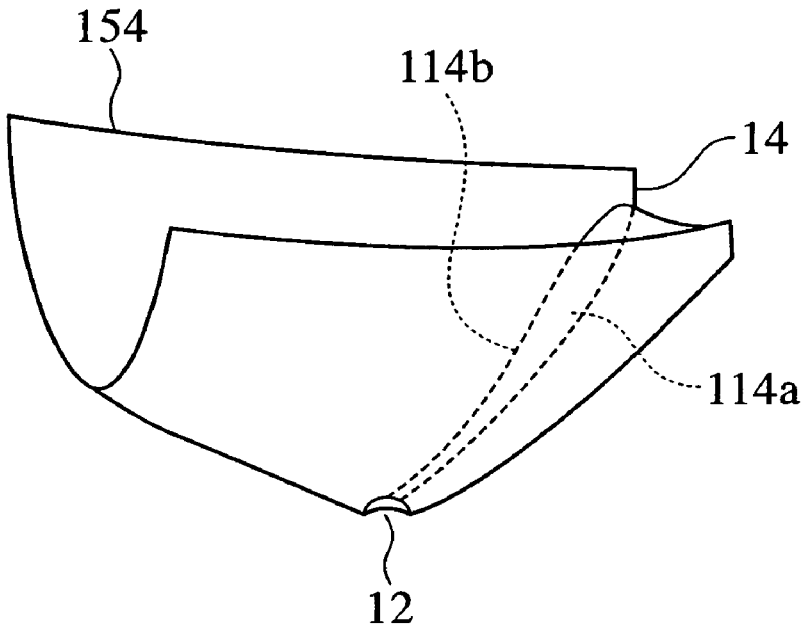
FIG. 15 is a perspective view showing an adhered sheet which is latched and kept in a substantially horn shape by the engagement latch mechanism.

The structure of the engagement latch mechanism 14 is not limited to that shown in FIGS. 12 and 14A. As shown in FIG. 14B, the projection portion 14*a*1 and the cutout portion 14*b*1 which are in approximately triangle shapes may be a projection portion 14*a*2 and a cutout portion 14*b*2 which are in approximately T-shapes. Moreover, the notch 114 may be a notch 114' in a saw-tooth shape as shown in FIG. 14C or a notch 114" in a wave-like shape as shown in FIG. 14D, instead of the simple V-shape as shown in FIGS. 14A and 14B. In FIG. 14C, the engagement latch mechanism 14 includes a projection portion 14*a*3 in an approximately circular shape and a cutout portion 14*b*3 in an approximately T-shape. In FIG. 14D, the engagement latch mechanism 14 includes projection portions 14*a*4 and 14*b*4 in shapes that engage with each other.

The notch (114, 114' or 114") formed in the adhered sheet 154 can be any shape as long as the adhered sheet 154 becomes an approximately horn shape (cone shape) as a whole when the edge portions 114*a* and 114*b* are overlapped with each other. In addition, the engagement latch mechanism 14 may be any mechanism as long as other members such as an adhesive, a clip or the like are not used therein and the blank portion which is a peripheral portion outside the molding portion (inside the dashed-line circle) in the adhered sheet 154 is utilized to latch and keep the adhered sheet 154.

In FIG. 12, the lubricant impregnating step (c4) and the first pressing step (d4) are the same as the lubricant impregnating step (c1) and the first pressing step (d1) in FIG. 5, respectively. However, the adhered sheet 154 impregnated with the lubricant 16 is kept in an approximately horn shape by overlapping the both edge portions 114*a* and 114*b* of the notch 114 and engaging the projection portion 14*a* and the cutout portion 14*b* of the engagement latch mechanism 14. Then, the adhered sheet 154 is molded by the first hot press molding (tentative molding) with the press device P1. Note that, when impregnating the adhered sheet 154 in the liquid of the lubricant 16 collected in the container 16*c* in the lubricant impregnating step (c4), the adhered sheet 154 may be latched and kept in an approximately horn shape by the engagement latch mechanism 14.

Since the shape of the adhered sheet 154 is kept in an approximately horn shape by the engagement latch mechanism 14 prior to being set onto the press device P1, setting workability is improved, and moldability in the first hot press molding is also improved. Hence, wrinkles or cracks can be reduced.

Further, the drying step (e4) and the thermosetting resin impregnating step (f4) in FIG. 12 are the same as the drying step (e1) and the thermosetting resin impregnating step (f1) in FIG. 5, respectively. The half-drying step (g4) and the second pressing step (h4) in FIG. 13 are the same as the half-drying step (g1) and the second pressing step (h1) in FIG. 6, respectively. Moreover, the moisture-proof agent applying step (i4) and the center and periphery removing step (j4) are the same as the moisture-proof agent applying step (i1) and the center and periphery removing step (j1) in FIG. 5, respectively.

In this way, the speaker diaphragm 60 shown in FIG. 16 is completed.

FIG. 11B is a modified example of the manufacturing method according to the fourth embodiment, in which the adhering step (a4) in FIG. 11A is omitted. In other words, the cloth or paper 13 is not adhered to one surface of the wooden sheet 10, and the above-described respective steps from the notch cutting/engagement latch mechanism forming step (b4) to the center and periphery removing step (j4) are performed on the wooden sheet 10 as it is. Although the non-woven cloth or Japanese paper 13 is not adhered on one surface of the wooden sheet 10, the speaker diaphragm can be formed.

However, the wooden sheet 10 with a thickness of approximately 0.1 to 0.9 mm very easily cracks when handling. Therefore, it is preferable that the adhering step (a4) is performed in advance to reinforce the wooden sheet 10 with the cloth or paper 13.

Fifth Embodiment

Figure 17:
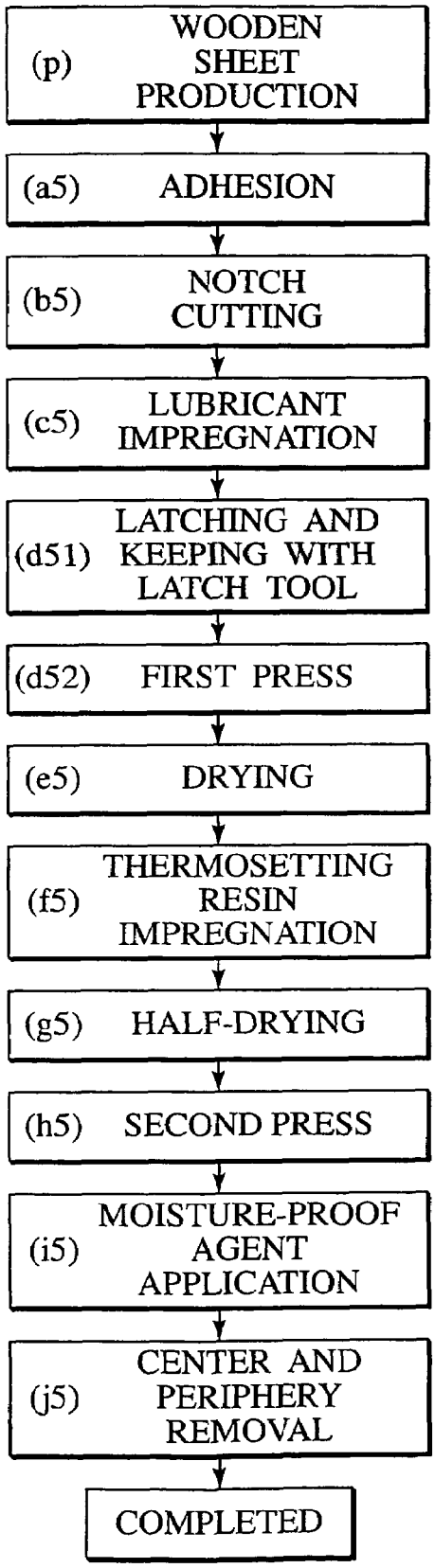
FIG. 17 is a flow diagram showing a manufacturing method according to a fifth embodiment.

A manufacturing method according to a fifth embodiment will be described with a focus on different points from the manufacturing method according to the first or fourth embodiment, and description of common points will be omitted as appropriate. The flow from (a5) to (j5) in FIG. 17 corresponds to processes from (a5) to (f5) in FIG. 18 and processes from (g5) to (j5) in FIG. 19. In the manufacturing method according to the fifth embodiment, the adhered sheet 15 having the approximately V-shaped notch 11 used in the manufacturing method of the first embodiment is used instead of the adhered sheet 154 having the engagement latch mechanism 14 described in FIGS. 14A to 14D.

Figure 18:
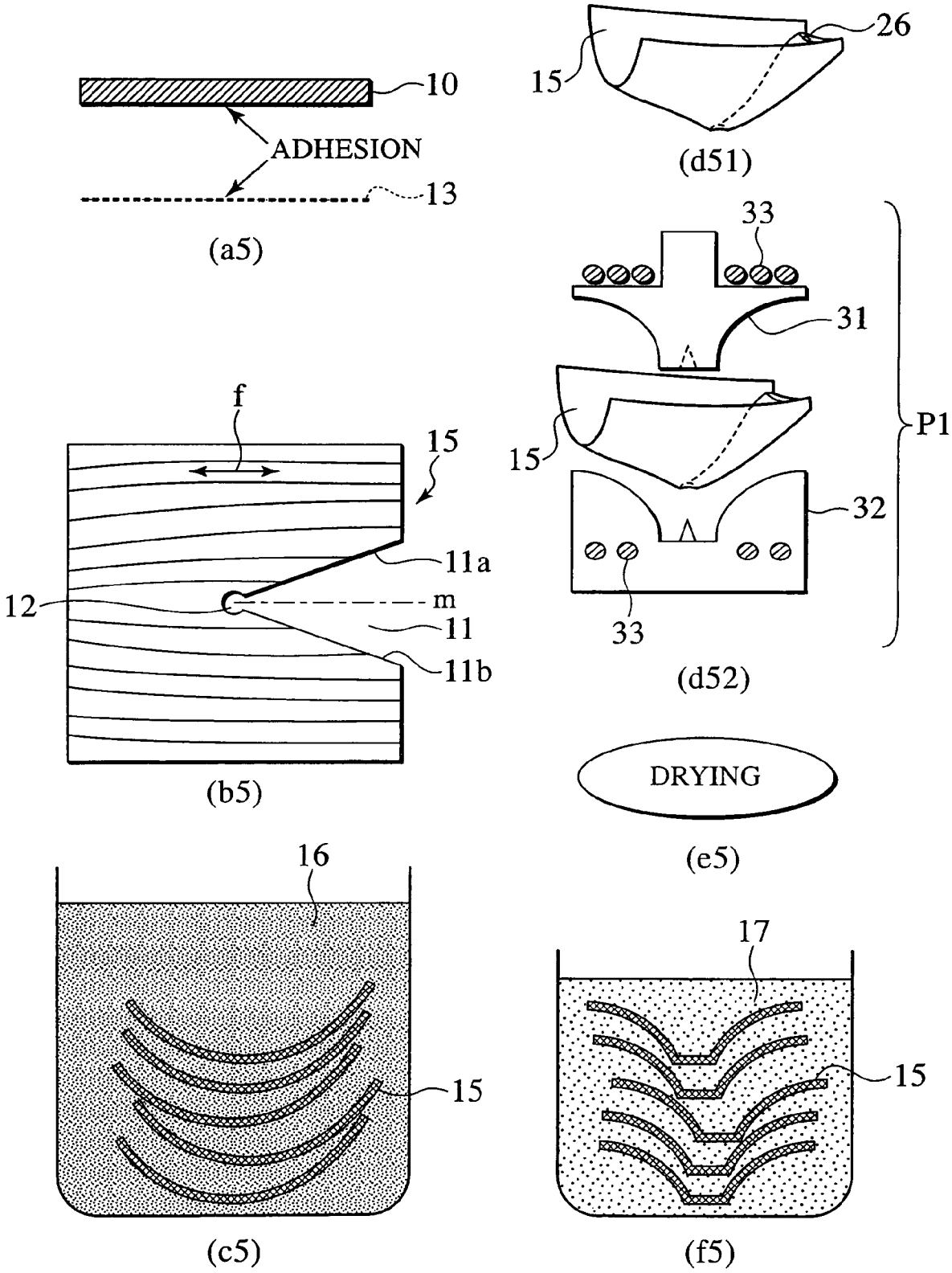
FIG. 18 is a view showing in detail the manufacturing method according to the fifth embodiment.

Steps from an adhering step (a5) to a lubricant impregnating step (c5) in FIG. 18 are the same as those from the adhering step (a1) to the lubricant impregnating step (c1) in FIG. 5, respectively. In the manufacturing method according to the fifth embodiment, unlike the manufacturing method of the fourth embodiment, the edge portions 11*a* and 11*b* of the notch 11 of the adhered sheet 15 are overlapped with each other, and the area outside the molding portion (blank portion) is latched and kept with a latching tool 26 so that the adhered sheet 15 is made into an approximately horn shape (latching and keeping step (d51)). A paper holding tool such as stapler, a clip can be used as the latching tool 26.

Figure 19:
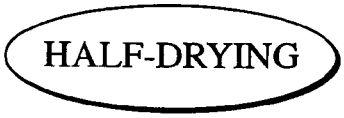
FIG. 19 is a view showing in detail the manufacturing method according to the fifth embodiment.
Figure 19:
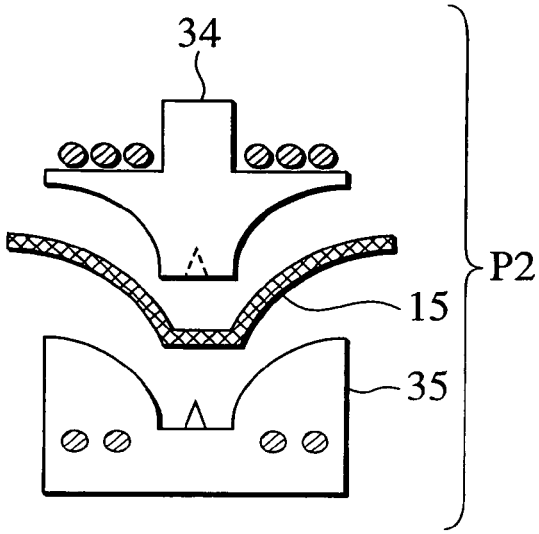
Figure 19:
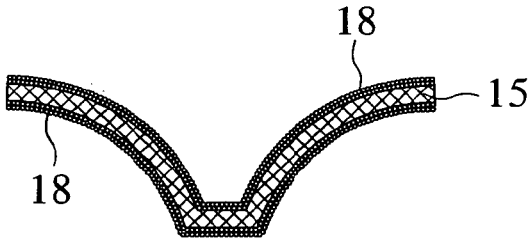
Figure 19:
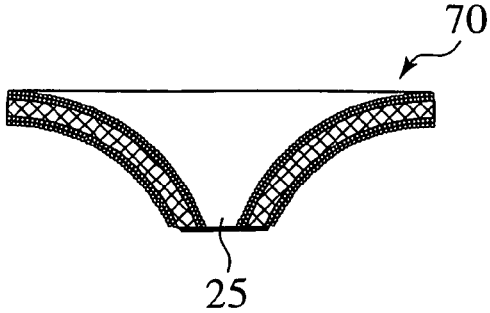

Steps from a first pressing step (d52) to a thermosetting resin impregnating step (f5) in FIG. 18 and steps from a half-drying step (g5) to a center and periphery removing step (j5) in FIG. 19 are the same as those from the first pressing step (d1) to the thermosetting resin impregnating step (f1) in FIG. 5 and those from the half-drying step (g1) to the center and periphery removing step (j1) in FIG. 6, respectively.

In this way, a speaker diaphragm 70 shown in FIG. 19 is completed.

Sixth Embodiment

Figure 20:
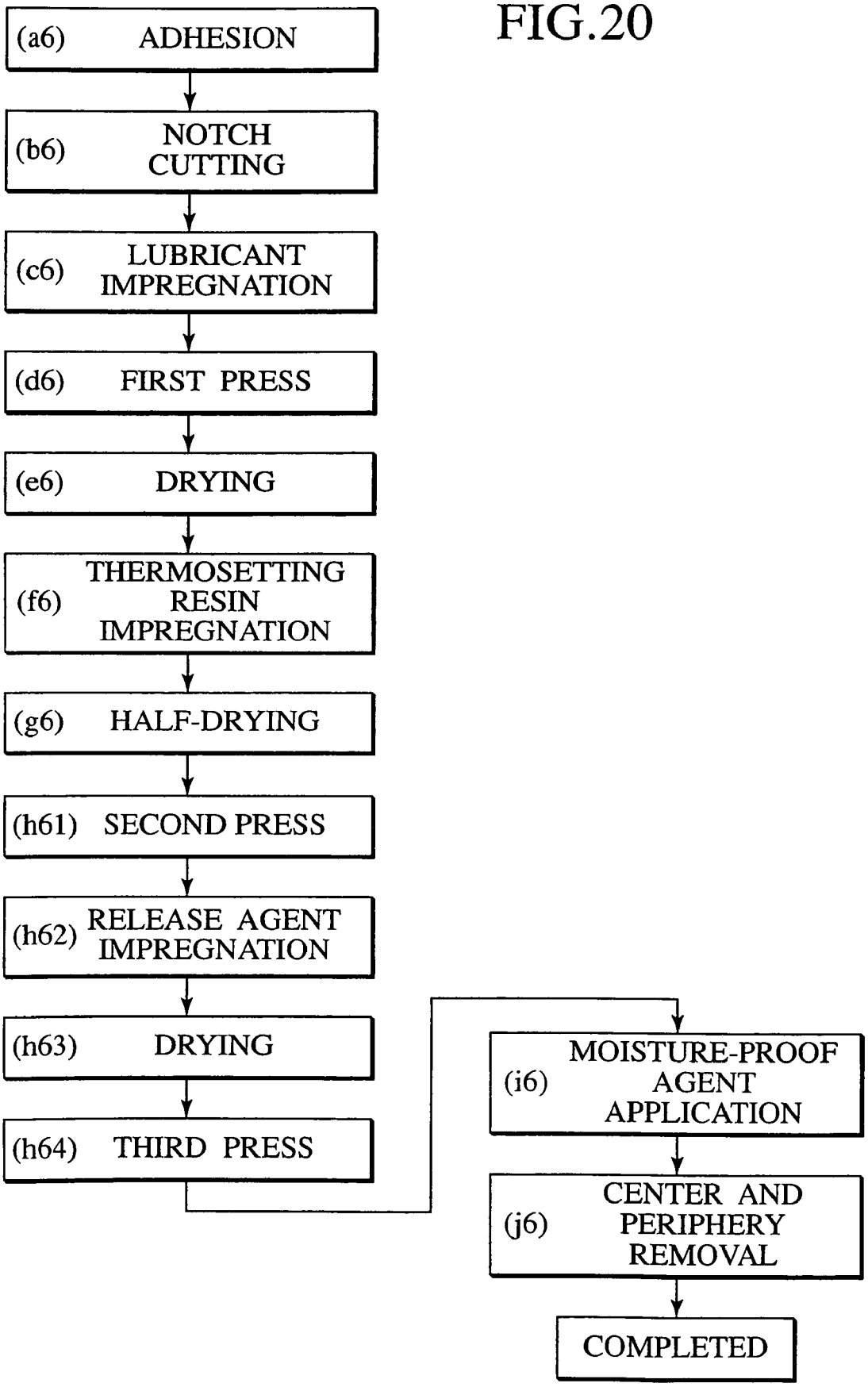
FIG. 20 is a flow diagram showing a manufacturing method according to a sixth embodiment.

A manufacturing method according to a sixth embodiment will be described with a focus on different points from the manufacturing method according to the first embodiment, and description of common points will be omitted as appropriate. In FIG. 20, steps from an adhering step (a6) to a half-drying step (g6) are the same as those from the adhering step (a1) to the half-drying step (g1) in FIG. 4, respectively.

In the manufacturing method according to the sixth embodiment, in order to improve the finish of the speaker diaphragm and to enhance the yield thereof, a press time in a second pressing step (h61) is shortened to approximately 2 to 30 seconds. Moreover, a release agent impregnating step (h62), a drying step (h63) and a third pressing step (h64) to be described later are provided.

Figure 21:
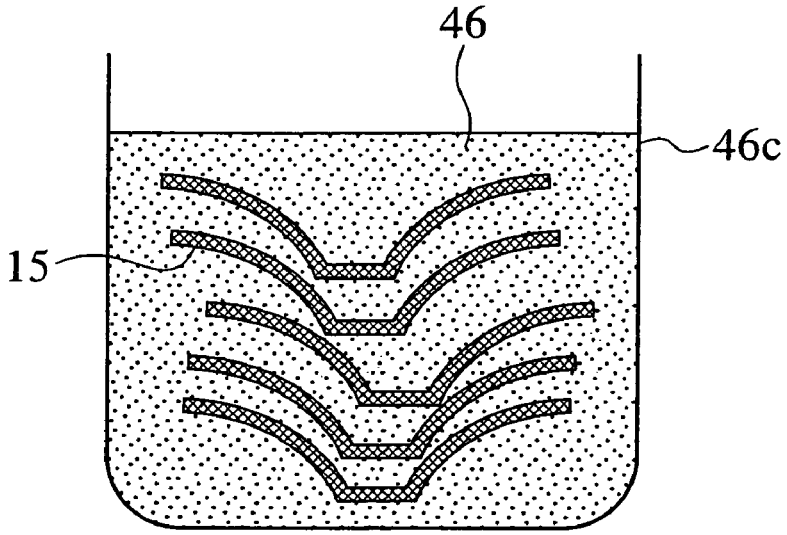
FIG. 21 is a view for describing the manufacturing method according to the sixth embodiment.

As shown in FIG. 21, the adhered sheet 15 molded in an approximately horn shape after the second hot press molding in the second pressing step (h61) is soaked in a liquid of a release agent 46 collected in a container 46*c* so that the release agent 46 is impregnated thereinto (release agent impregnating step (h62)). Silicon is used as the release agent 46, for example. Then, the adhered sheet 15 impregnated with the release agent 46 is taken out of the container 46*c* to be dried (drying step (h63)).

Figure 22:
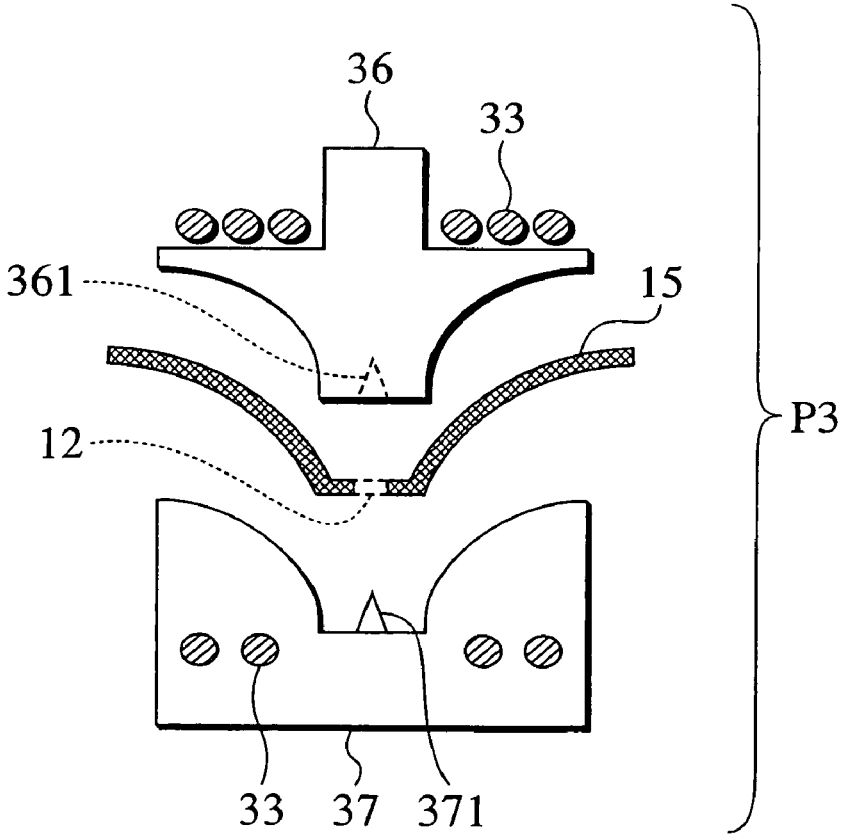
FIG. 22 is a view for describing the manufacturing method according to the sixth embodiment.

Subsequently, as shown in FIG. 22, the third hot press molding is performed on the adhered sheet 15 impregnated with the release agent 46 with a press device P3 including an upper mold 36 and a lower mold 37, both of which have heaters 33 (third pressing step (h64)). The lower mold 37 has a projecting pin 371, while the upper mold 36 has a recess 361 to be engaged with the projecting pin 371.

Here, preferred set conditions for the third hot press molding are a press pressure of approximately 20 to 40 kg, metal mold temperatures of approximately 80 to 200° C. for the upper mold 36 and approximately 100 to 200° C. for the lower mold 37, and a press time of approximately 2 to 60 seconds.

Seventh Embodiment

Figure 23:
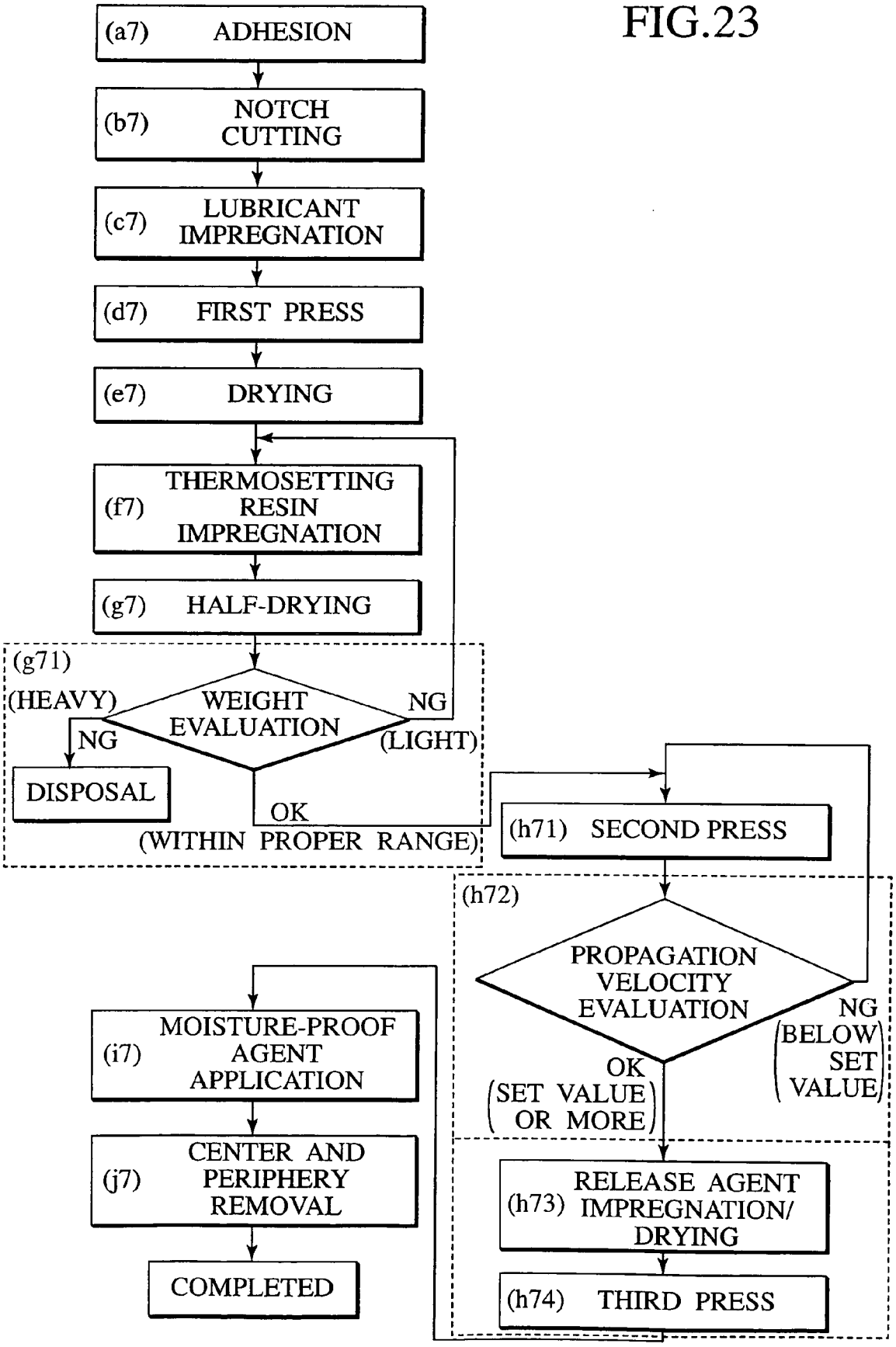
FIG. 23 is a flow diagram showing a manufacturing method according to a seventh embodiment.

A manufacturing method of a seventh embodiment shown in FIG. 23 is an improved manufacturing method of the sixth embodiment. Steps from an adhering step (a7) to a half-drying step (g7) in FIG. 23 are the same as those from the adhering step (a6) to the half-drying step (g6) in FIG. 20, respectively. Moreover, a second pressing step (h71) and a third pressing step (h74) are the same as the second pressing step (h61) and the third pressing step (h64) in FIG. 20, respectively. Furthermore, a release agent impregnating/drying step (h73) is the equivalent of the release agent impregnating step (h62) and the drying step (h63) in FIG. 20.

In the seventh embodiment shown in FIG. 23, a weight evaluating step (g71) is provided after the half-drying step (g7). That is, a weight of the adhered sheet 15 with the half-dried thermosetting resin 17 is measured, and if the weight is in a designated range, the adhered sheet 15 is passed on to the subsequent second pressing step (h71). If the weight of the adhered sheet 15 is below the designated range, the adhered sheet 15 is returned to the thermosetting resin impregnating step (f7), and if the weight is over the designated range, the adhered sheet 15 is disposed as waste. In this way, even when the degrees of impregnation of the thermosetting resin 17 vary according to the characteristics of the wooden sheet 10 such as the density thereof, only adhered sheets 15 in appropriate states can be selected.

Figure 24:
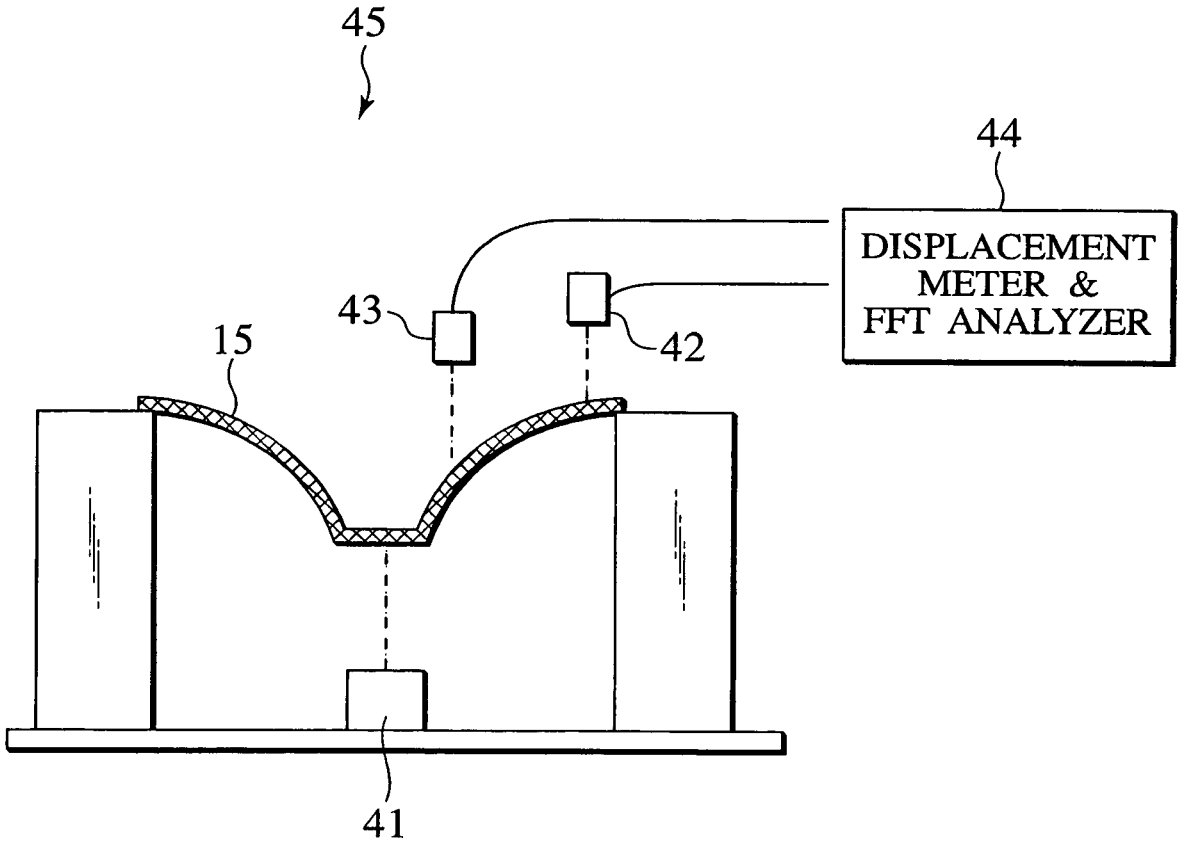
FIG. 24 is a view for describing the manufacturing method according to the seventh embodiment.

The uniform second hot press molding may be insufficient in view of individual differences (difference in densities or the like) of the adhered sheet 15. Thus, some variations can occur among sound wave velocities in connection with stiffness. Therefore, in the seventh embodiment shown in FIG. 23, a propagation velocity evaluating step (h72) is provided after the second pressing step (h71). That is, the sound wave velocities of the adhered sheet 15 after the second hot press molding are measured with a propagation velocity measuring device 45 shown in FIG. 24. Specifically, as shown in FIG. 24, for example, a YAG laser 41 is pulse-driven, and ultrasonic vibrations are generated on the adhered sheet 15 by pulses generated by the YAG laser 41. The ultrasonic vibrations are measured by probes 42 and 43, and the sound wave velocities are obtained from delays in the ultrasonic vibrations between the probes 42 and 43 by a displacement meter & fast Fourier transform (FET) analyzer 44. The adhered sheets 15 having velocities equal to or faster than designated velocity are moved on to the subsequent release agent impregnating/drying step (h73), and the adhered sheets 15. having the velocities below the designated velocity are returned to the second pressing step (h71).

Sound characteristics can be stabilized and yield can be improved by evaluating, at least once, the propagation velocities in the propagation velocity evaluating step (h72).

Eighth Embodiment

Figure 25:
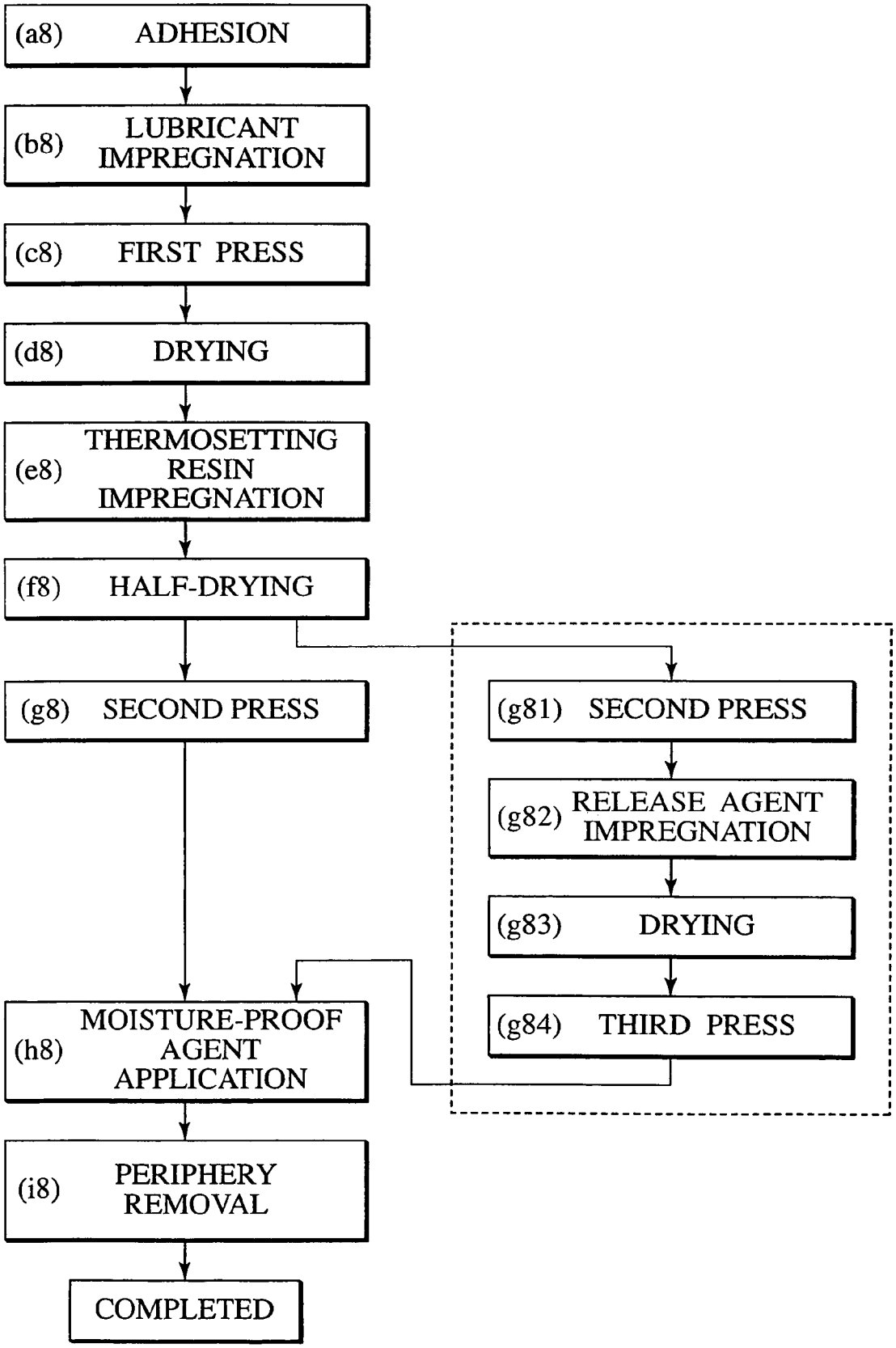
FIG. 25 is a flow diagram showing a manufacturing method according to an eighth embodiment.
Figure 26:
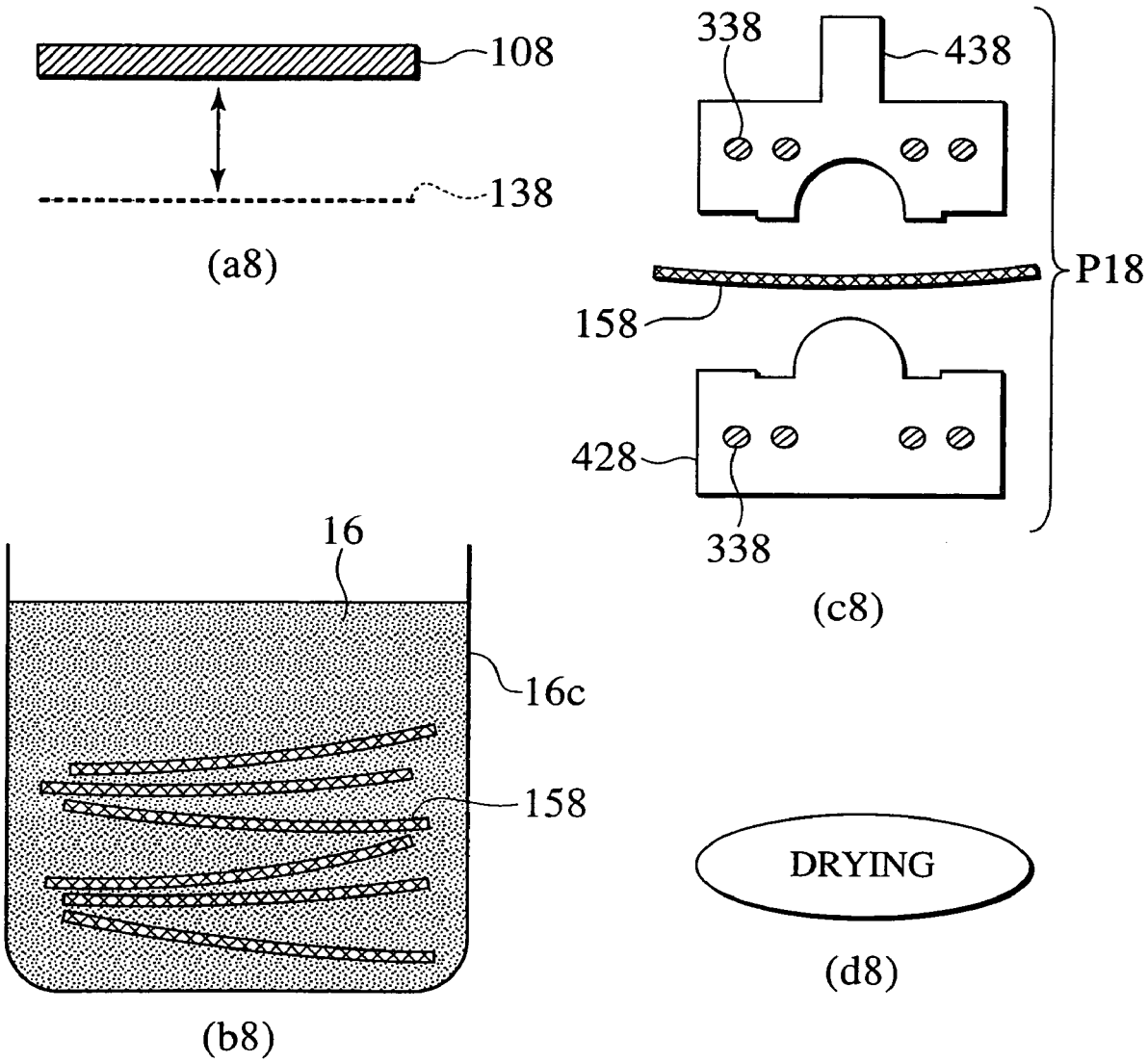
FIG. 26 is a view showing in detail the manufacturing method according to the eighth embodiment.
Figure 27:
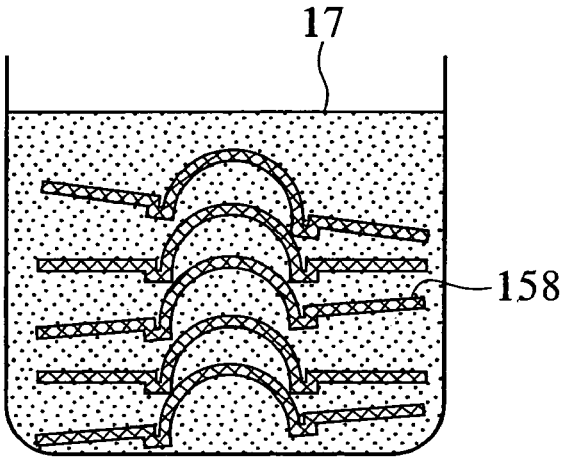
FIG. 27 is a view showing in detail the manufacturing method according to the eighth embodiment.
Figure 27:
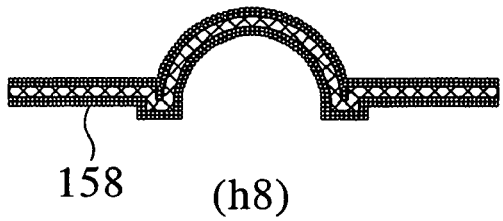
Figure 27:
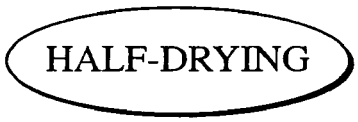
Figure 27:
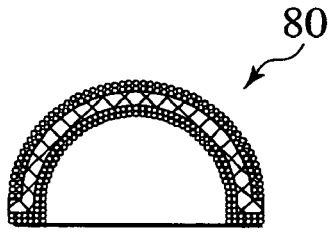
Figure 27:
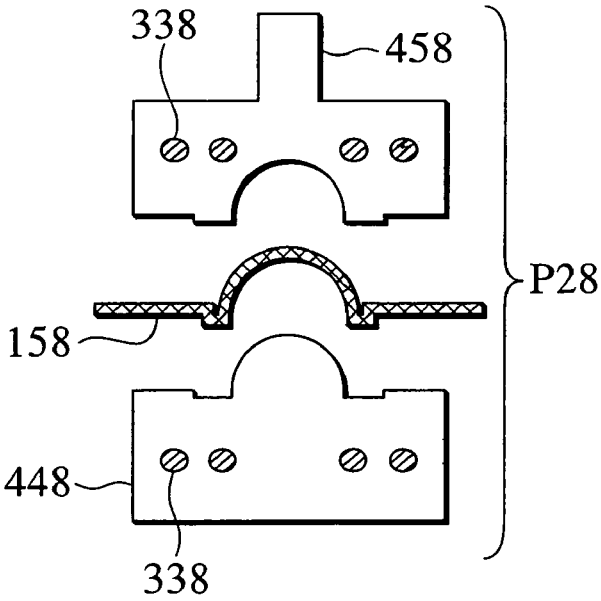
Figure 28:
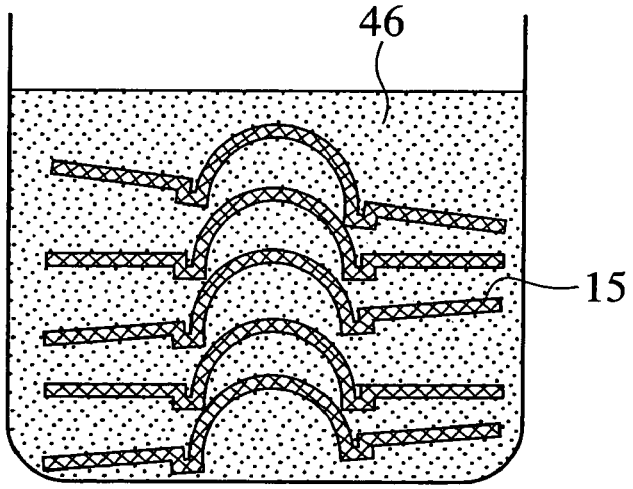
FIG. 28 is a view for describing the manufacturing method according to the eighth embodiment.

An eighth embodiment is a manufacturing method of an approximately dome-shaped speaker diaphragm used for a dome-type dynamic speaker. The flow from (a8) to (i8) in FIG. 25 corresponds to processes from (a8) to (d8) in FIG. 26 and processes from (e8) to (i8) in FIG. 27. The manufacturing method according to the eighth embodiment includes nine steps from (a8) to (i8) performed after a wooden sheet 108 is formed similarly to the wooden sheet 10 formed in the basis material preparation step described in FIGS. 3A and 3B. An adhering step (a8) a lubricant impregnating step (b8), a first pressing step (c8), a drying step (d8), a thermosetting resin impregnating step (e8), a half-drying step (f8), a second pressing step (g8), a moisture-proof agent applying step (h8) and a periphery removing step (i8) are sequentially performed to form a speaker diaphragm 80 in an approximately dome shape as shown in FIG. 27.

Meanwhile, between the half-drying step (f8) and the moisture-proof agent applying step (h8), a second pressing step (g81) a release agent impregnating step (g82), a drying step (g83), and a third pressing step (g83) may be provided as shown in a dashed-line.

Hereinbelow, details of the respective steps will be described in sequence using FIGS. 26 and 27. In the manufacturing method according to the eighth embodiment, description of some of the common points with the manufacturing method of the first embodiment may be omitted. In FIG. 26, on one surface of the wooden sheet 108 with a thickness of 0.1 to 0.9 mm (preferably around 0.3 mm), a thin cloth or paper 138 with a thickness of approximately 0.02 to 0.30 mm is adhered with an adhesive to produce an adhered sheet 158 in an approximately square shape (adhering step (a8)). The wooden sheet 108 has an area smaller than those of the wooden sheets 10 used for manufacturing of the approximately horn-shaped speaker diaphragms 30, 40, 50, 60 and 70 in the first to seventh embodiments. The surface of the adhered sheet 158 on which the cloth or paper 138 is adhered is to be the back surface of the finished speaker diaphragm 80.

In the manufacturing step of the approximately dome-shaped speaker diaphragm 80, for example, the approximately V-shaped notch 11 described in FIG. 5 is not required to be provided.

The adhered sheet 158 is soaked, for 5 to 60 minutes, in a liquid of the lubricant 16 collected in the container 16*c* so that the lubricant 16 is sufficiently impregnated thereinto (lubricant impregnating step (b8)). Then, using a press device P18, which is a metal mold made up of an upper mold 438 and a lower mold 428 each having heaters 338, the adhered sheet 158 impregnated with the lubricant 16 is tentatively molded in an approximately dome shape by the first hot press molding (first pressing step (c8)). Subsequently, the tentatively molded adhered sheet 158 is put into a drying furnace, which is not shown, to be completely dried (drying step (d8)).

In FIG. 27, the adhered sheet 158, after dried is soaked, for approximately 30 to 180 minutes, in a liquid of the thermosetting resin 17 collected in the container 17*c* so that the thermosetting resin 17 is sufficiently impregnated into the adhered sheet 158 (thermosetting resin impregnating step (e8)). The adhered sheet 158 impregnated with the thermosetting resin 17 is put into a drying furnace, which is not shown, and the thermosetting resin 17 is half-dried (half-drying step (f8)).

Thereafter, using a press device P28 which has a similar structure to the press device P18 and is made up of an upper mold 458 and a lower mold 448, the adhered sheet 158 with the half-dried thermosetting resin 17 is hot press molded again (second pressing step (g8)). After the second hot press molding, volatile components are evaporated, and the adhered sheet 158 is molded to be a stable, approximately dome-shape.

Furthermore, the moisture-proof agent 18 is applied, with a brush or by immersing thereinto, to the front and back surfaces of the adhered sheet 158 after the second hot press molding, and then dried naturally or completely dried in a drying furnace (moisture-proof agent applying step (h8)). Lastly, the periphery of the adhered sheet 158 on which the moisture-proof agent 18 is applied is removed, whereby the approximately dome-shaped speaker diaphragm 80, which is a diaphragm determined to have a predetermined dimension, is completed (periphery removing step (i8)).

Figure 29:
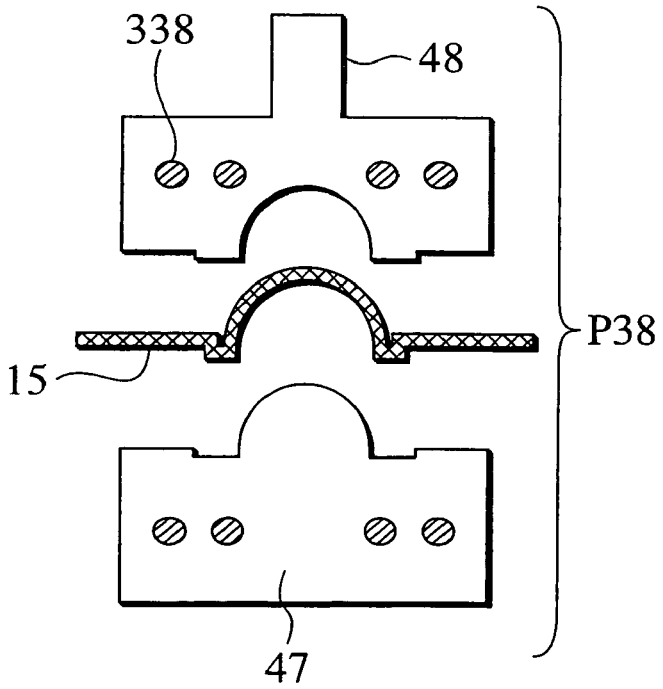
FIG. 29 is a view for describing the manufacturing method according to the eighth embodiment.

Also in the eighth embodiment, the step between the half-drying step (f8) and the moisture-proof agent applying step (h8) is not limited to the second pressing step (g8). Similarly to the six embodiment described in FIG. 20, the second pressing step (g81), the release agent impregnating step (g82), the drying step (g83), and the third pressing step (g83) with a press device P38 made up of an upper mold 488 and a lower mold 478 shown in FIG. 29 may be provided. Thus, yield of the adhered sheet 158 is enhanced, and finish of the mold processing is further improved.

Ninth Embodiment

Figure 30:
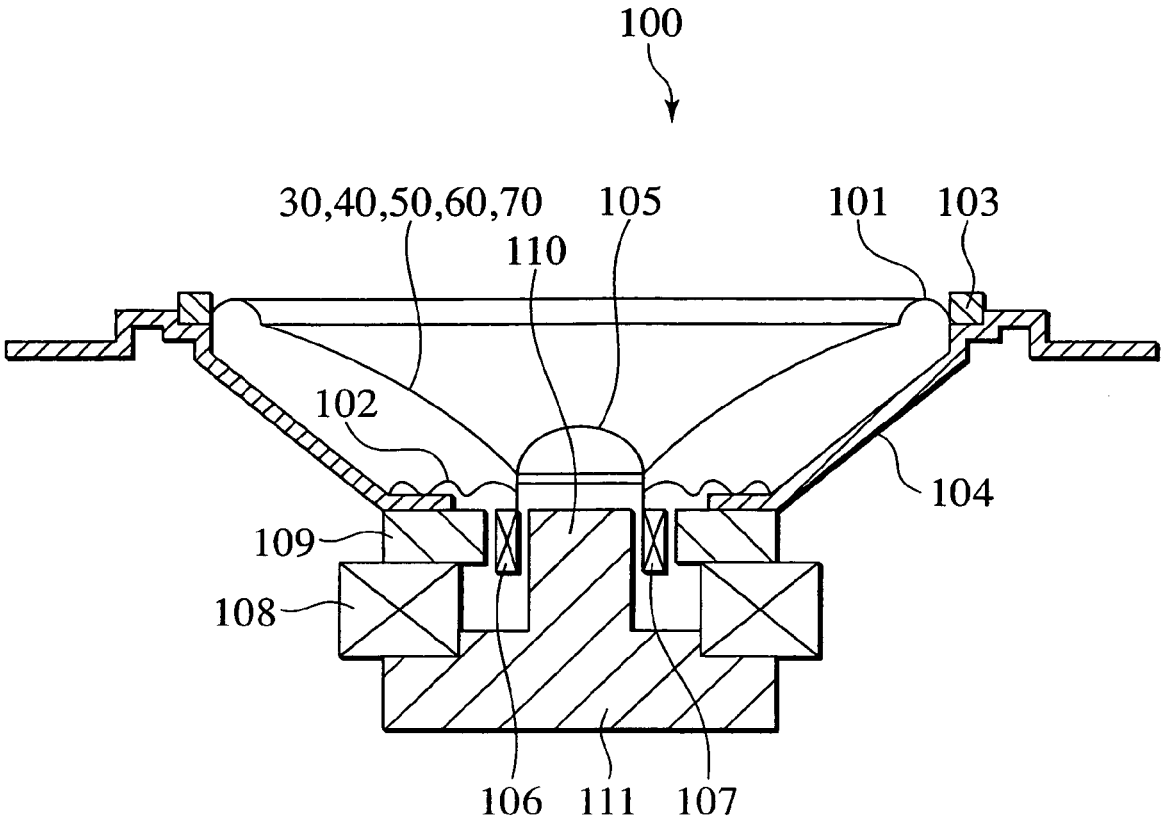
FIG. 30 is a cross-sectional view showing an example of a structure of a cone-type dynamic speaker according to a ninth embodiment.

A ninth embodiment illustrated in FIG. 30 shows an example of a structure of a cone-type dynamic speaker 100 using the approximately horn-shaped speaker diaphragm 30, 40, 50, 60 or 70 of the first to seventh embodiments.

As shown in FIG. 30, the cone-type dynamic speaker 100 includes: the approximately horn-shaped speaker diaphragm 30, 40, 50, 60 or 70; an edge 101 for supporting the speaker diaphragm 30, 40, 50, 60 or 70; a damper 102; a gasket 103 adhered on the periphery of the edge 101; a frame 104; a cap 105 in an approximately dome-shape for covering the center hole 25 (see FIG. 7, etc.) of the speaker diaphragm 30, 40, 50, 60, or 70; a voice coil bobbin 106 for providing driving force to the speaker diaphragm 30, 40, 50, 60 or 70; a voice coil 107 wound on the voice coil bobbin 106; a magnet 108; a top plate 109; a pole piece 110; and a back plate 111. The cone-type dynamic speaker 100 is used as a full-range speaker or a bass/midrange speaker.

Incidentally, the shape and the dimension of the approximately dome-shaped speaker diaphragm 80 in the eighth embodiment are extremely similar to those of the approximately dome-shaped cap 105 covering the center hole 25 of the speaker diaphragm 30, 40, 50, 60 or 70. Accordingly, the speaker diaphragm 80 can be used as the cap 105. In this way, in the front surface of the cone-type dynamic speaker 100, the wooden speaker diaphragm 30, 40, 50, 60 or 70 is combined with the wooden speaker diaphragm 80. Thus, the entire cone-type dynamic speaker 100 will have a beautiful, high-class look as well as uniformity.

Tenth Embodiment

Figure 31:
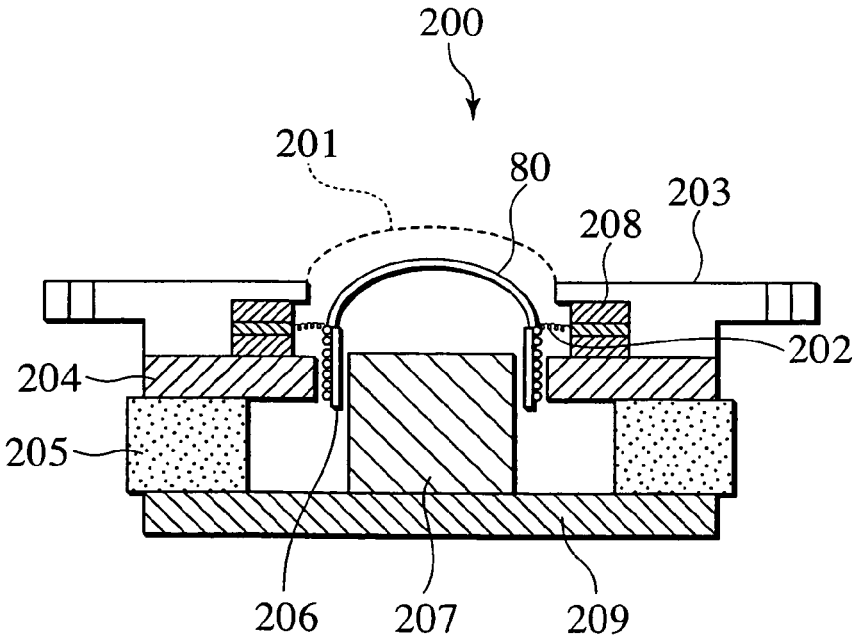
FIG. 31 is a cross-sectional view showing an example of a structure of a dome-type dynamic speaker according to a tenth embodiment.

Tenth embodiment illustrated in FIG. 31 shows an example of a dome-type dynamic speaker 200 using the approximately dome-shaped speaker diaphragm 80 according to the eighth embodiment.

As shown in FIG. 31, the dome-type dynamic speaker 200 includes: the approximately dome-shaped speaker diaphragm 80; a meshed protector 201; an edge 202 for supporting the speaker diaphragm 80; a flange 203; a top plate 204; a magnet 205; a voice coil 206; a pole piece 207; a packing 208; and a back plate 209. The dome-type dynamic speaker 200 is used as a treble speaker.

Eleventh Embodiment

Figure 32A:
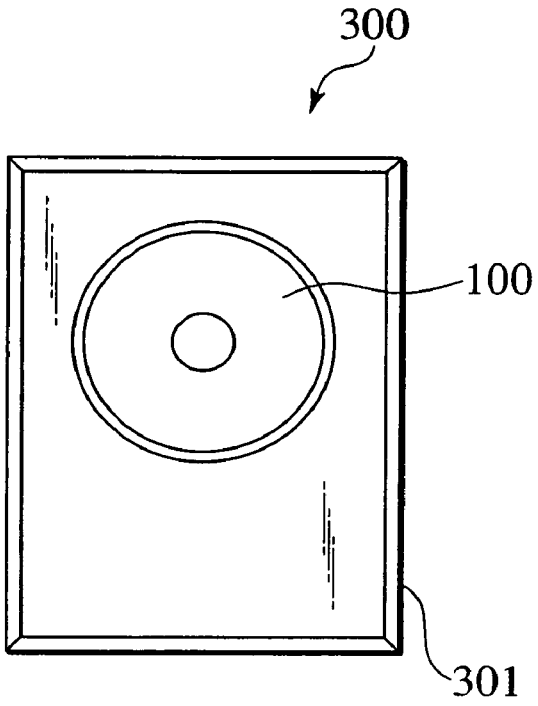
FIG. 32A is a front view showing a speaker device employing a cone-type dynamic speaker according to an eleventh embodiment.
Figure 32B:
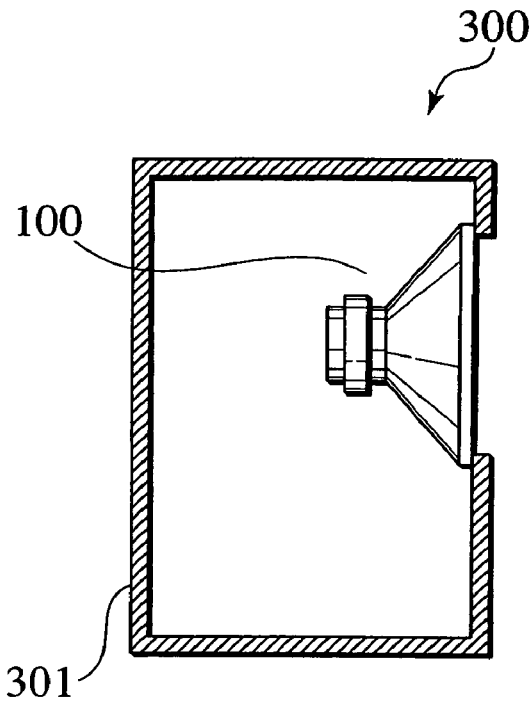
FIG. 32B is a cross-sectional view showing the speaker device employing the cone-type dynamic speaker according to the eleventh embodiment.

An eleventh embodiment illustrated in FIGS. 32A and 32B shows a speaker device 300 using the cone-type dynamic speaker 100 of FIG. 30. FIG. 32A is a front view of the speaker device 300, and FIG. 32B is a longitudinal sectional view of the speaker device 300. The cone-type dynamic speaker 100 is installed in a cabinet made of wood or plastic, or in a housing 301 which is called an enclosure.

Twelfth Embodiment

Figure 33:
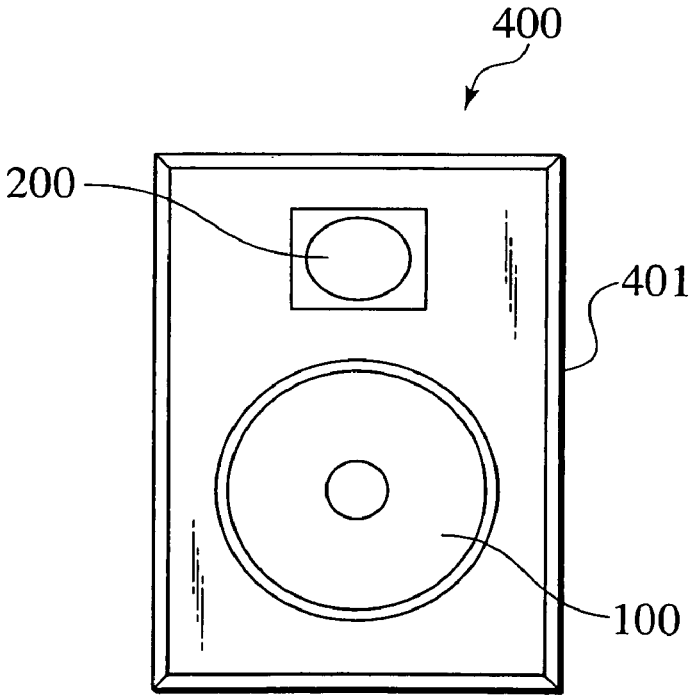
FIG. 33 is a front view showing a speaker device employing a cone-type dynamic speaker and a dome-type dynamic speaker according to a twelfth embodiment.

A twelfth embodiment illustrated in FIG. 33 shows a speaker device 400 using the cone-type dynamic speaker 100 of FIG. 30 and the dome-type dynamic speaker 200 of FIG. 31. FIG. 33 is a front view of the speaker device 400. The cone-type dynamic speaker 100 as a woofer and the dome-type dynamic speaker 200 as a tweeter are installed in a cabinet made of wood or plastic or in a housing 401 which is called an enclosure to make the 2-way speaker device 400. Although not shown, a squawker and the like may be added such that the speaker device 400 includes three or more speakers.

Figure 34A:
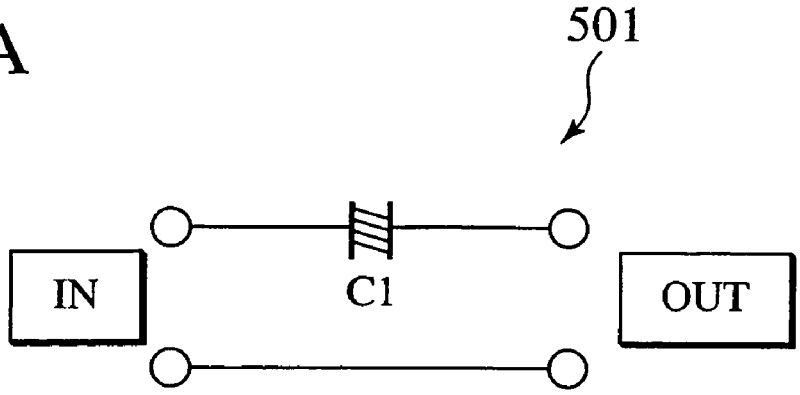
FIG. 34A is a circuit diagram showing a network circuit connected to a dome-type dynamic speaker.
Figure 34B:
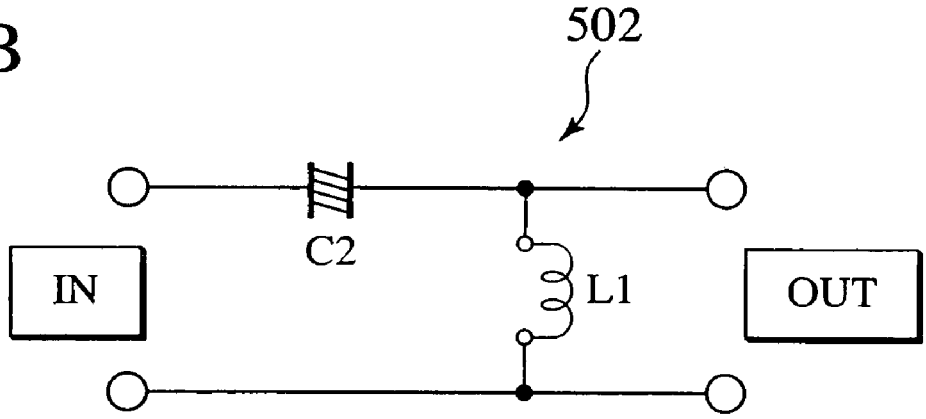
FIG. 34B is a circuit diagram showing a network circuit connected to a dome-type dynamic speaker.
Figure 34C:
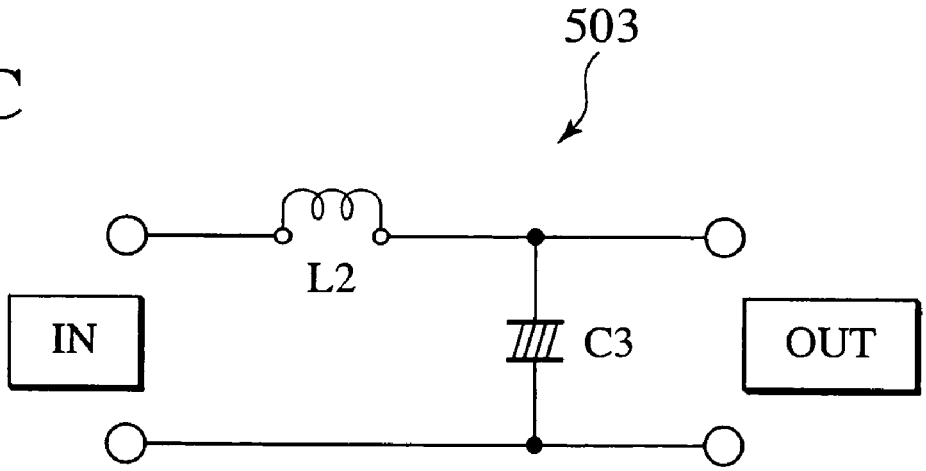
FIG. 34C is a circuit diagram showing a network circuit connected to a cone-type dynamic speaker.

To the dome-type dynamic speaker 200, network circuits 501 and 502 shown in FIGS. 34A and 34B are serially connected to cut bass. When the frequency characteristics of the cone-type dynamic speaker 100 as the woofer fluctuate in the vicinity of a crossover frequency, a network circuit 503 shown in FIG. 34C, which cuts treble, is connected. Note that C1, C2 and C3 in FIGS. 34A to 34C are capacitors, and L1 and L2 are inductor coils.

According to the study by the inventor, in order to further improve, compared to the conventional diaphragms made of paper pulp or aluminum, the definition of the reproduced sounds and the crisp sounds in speaker diaphragms 30, 40, 50, 60, 70 and 80 of the respective embodiments, in the dynamic speakers 100 and 200, and in the speaker device 300 and 400, it has become clear that to select a wooden material having a longitudinal propagation velocity of 4.5 to 6.0 km/second and a horizontal propagation velocity of 2.0 to 4.5 km/second is preferable.

In particular, improvement in the sound quality is significant when the longitudinal propagation velocity is in a range from 4.5 to 6.0 km/second while the horizontal propagation velocity is in a range from 2.0 to 2.5 km/second, and a wooden material having an internal loss coefficient in a range from 0.02 to 0.03 is selected to be used as the diaphragm. Here, birch (solid wood) is proved to be the best material. It goes without saying that other wooden material such as beech, oak, cherrywood, or linden can be used instead of birch.

Figure 35:
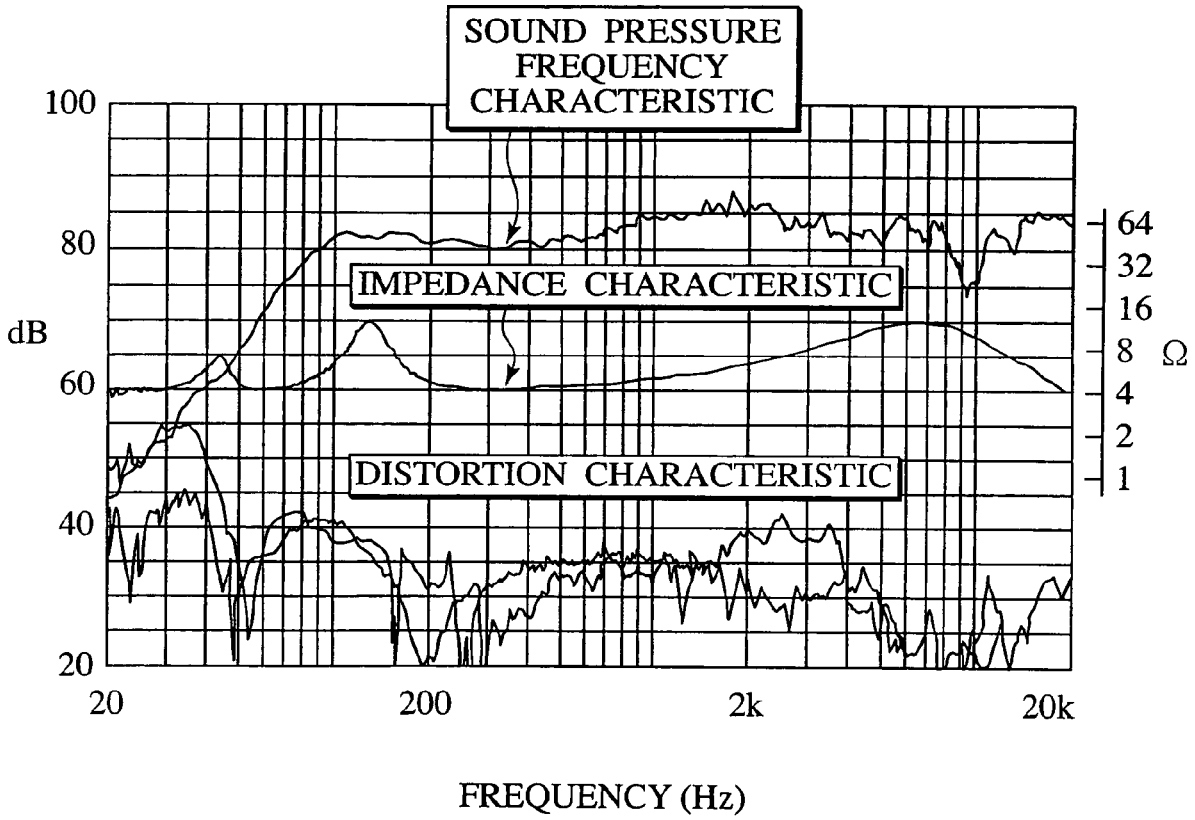
FIG. 35 is a characteristic graph showing a sound pressure frequency characteristic, an impedance characteristic, and a distortion characteristic of the speaker device in FIG. 33.

FIG. 35 shows a sound pressure frequency characteristic, an impedance characteristic and a distortion characteristic in the speaker device 400 of FIG. 33, when the bore diameter of the cone-type dynamic speaker 100 is 8 cm, the network circuit 502 shown in FIG. 34B is used, capacity of the capacitor C2 is 1.5 ,,F, and inductance of the inductor coil L1 is 0.18 mH. Units of the sound pressure frequency characteristic and the distortion characteristic are dB of the left vertical axis, and a unit of the impedance characteristic is ,, of the right vertical axis. All of the sound pressure frequency characteristic, the impedance characteristic and the distortion characteristic are excellent characteristics.

According to the foregoing embodiments, there can be provided wooden speaker diaphragms and dynamic speakers which are extremely effective in improving sound characteristics of an audio speaker and do not have much deterioration with time such as deformation and cracks. Moreover, manufacturing methods of the speaker diaphragms can be provided, where the wooden speaker diaphragms with sufficient moldability and excellent mass productivity can be manufactured with low costs.

It should be understood that many modifications and adaptations of the invention will become apparent to those skilled in the art and it is intended to encompass such obvious modifications and changes in the scope of the claims appended hereto.

What is claimed is:

1. A manufacturing method of a speaker diaphragm where a speaker diaphragm is manufactured from a piece of wooden sheet, comprising:

a Japanese-sake impregnating step of impregnating the wooden sheet with Japanese sake;

a first pressing step of tentatively molding the wooden sheet in a predetermined shape;

a first drying step of drying the wooden sheet tentatively molded in the predetermined shape;

a thermosetting resin impregnating step of impregnating thermosetting resin into the wooden sheet dried in the first drying step;

a half-drying step of half-drying the wooden sheet impregnated with the thermosetting resin;

a second pressing step of molding the wooden sheet half-dried in the half-drying step in a predetermined shape by heating and pressing; and a moisture-proof agent applying step of applying a moisture-proof agent to the wooden sheet molded in the predetermined shape.

2. The manufacturing method of a speaker diaphragm according to claim 1, further comprising:

an adhering step of adhering a cloth or paper on one surface of the wooden sheet to make the wooden sheet to be an adhered sheet in advance, the adhering step being provided prior to the Japanese-sake impregnating step.

3. The manufacturing method of a speaker diaphragm according to claim 1, wherein the predetermined shape is an approximately horn shape, a notch cutting step of forming an approximately V-shaped notch on the wooden sheet is further included prior to the Japanese-sake impregnating step, the first pressing step is a step of overlapping, heating and pressing edge portions of the notch of the wooden sheet to tentatively mold the wooden sheet in the approximately horn shape, and a center and periphery removing step of removing a center hole for a voice coil and a periphery from the wooden sheet molded in the approximately horn shape to form a speaker diaphragm having a predetermined dimension and shape is further included after the moisture-proof agent applying step.

4. The manufacturing method of a speaker diaphragm according to the claim 2, wherein the predetermined shape is an approximately horn shape, a notch cutting step of forming an approximately V-shaped notch on the adhered sheet is further included prior to the Japanese-sake impregnating step, the first pressing step is a step of overlapping, heating and pressing edge portions of the notch of the adhered sheet to tentatively mold the adhered sheet in the approximately horn shape, and a center and periphery removing step of removing a center hole for a voice coil and a periphery from the adhered sheet molded in the approximately horn shape to form a speaker diaphragm having a predetermined dimension and shape is further included after the moisture-proof agent applying step.

5. The manufacturing method of a speaker diaphragm according to claim 3, further comprising:

a latching and keeping step of latching, with a latching tool, a portion outside an area to be press molded in the first pressing step such that the wooden sheet is latched and kept in the approximately horn shape while the edge portions of the notch of the wooden sheet are overlapped, the latching and keeping step being provided prior to the first pressing step.

6. The manufacturing method of a speaker diaphragm according to claim 4, further comprising:

a latching and keeping step of latching, with a latching tool, a portion outside an area to be press molded in the first pressing step such that the adhered sheet is latched and kept in the approximately horn shape while the edge portions of the notch of the adhered sheet are overlapped, the latching and keeping step being provided prior to the first pressing step.

7. The manufacturing method of a speaker diaphragm according to claim 3, wherein, when the approximately V-shaped notch is formed on the wooden sheet in the notch cutting step, an engagement latch mechanism which is used for engaging the edge portions of the notch of the wooden sheet and is integrated with the wooden sheet is formed, and prior to the first pressing step, the edge portions of the notch are engaged by the engagement latch mechanism such that the wooden sheet is latched and kept in the approximately horn shape while the edge portions of the notch of the wooden sheet are overlapped.

8. The manufacturing method of a speaker diaphragm according to claim 4, wherein, when the approximately V-shaped notch is formed on the adhered sheet in the notch cutting step, an engagement latch mechanism which is used for engaging the edge portions of the notch of the adhered sheet and is integrated with the adhered sheet is formed, and prior to the first pressing step, the edge portions of the notch are engaged by the engagement latch mechanism such that the adhered sheet is latched and kept in the approximately horn shape while the edge portions of the notch of the adhered sheet are overlapped.

9. The manufacturing method of a speaker diaphragm according to claim 1, further comprising:

a release agent impregnating step of impregnating a release agent into the wooden sheet;

a second drying step of drying the wooden sheet impregnated with the release agent; and a third pressing step of heating and pressing the wooden sheet dried in the second drying step to mold in a predetermined shape, the release agent impregnating step, the second drying step, and the third pressing step being provided between the second pressing step and the moisture-proof agent applying step.

10. The manufacturing method of a speaker diaphragm according to claim 2, further comprising:

a release agent impregnating step of impregnating a release agent into the adhered sheet;

a second drying step of drying the adhered sheet impregnated with the release agent; and a third pressing step of heating and pressing the adhered sheet dried in the second drying step to mold in a predetermined shape, the release agent impregnating step, the second drying step, and the third pressing step being provided between the second pressing step and the moisture-proof agent applying step.

11. The manufacturing method of a speaker diaphragm according to claim 1, further comprising:

a weight evaluating step of measuring a weight of the half-dried wooden sheet and returning the wooden sheet of which the weight is below a designated range to the thermosetting impregnating step, the weight evaluating step being provided after the half-drying step.

12. The manufacturing method according to claim 2, further comprising:

a weight evaluating step of measuring a weight of the half-dried adhered sheet and returning the adhered sheet of which the weight is below a designated range to the thermosetting impregnating step, the weight evaluating step being provided after the half-drying step.

13. The manufacturing method of a speaker diaphragm according to claim 11, further comprising:

a propagation velocity evaluating step of measuring a sound wave velocity of the wooden sheet and returning the wooden sheet of which the sound wave velocity is below a designated velocity to the second pressing step, the propagation velocity evaluating step being provided after the second pressing step.

14. The manufacturing method according to claim 2, further comprising:

a propagation velocity evaluating step of measuring a sound wave velocity of the adhered sheet and returning the adhered sheet of which the sound wave velocity is below a designated velocity to the second pressing step, the propagation velocity step being provided after the second pressing step.

* * * * *

UNITED STATES PATENT AND TRADEMARK OFFICE

CERTIFICATE OF CORRECTION

PATENT NO. : 7,677,355 B2
APPLICATION NO. : 12/292327
DATED : March 16, 2010
INVENTOR(S) : Satoshi Imamura et al.

It is certified that error appears in the above-identified patent and that said Letters Patent is hereby corrected as shown below:

Column 22, Claim 13, Line 9
Please delete "11"
and replace with -- 1 --

Signed and Sealed this

Eleventh Day of May, 2010

David J. Kappos

David J. Kappos
*Director of the United States Patent and Trademark Office*